US008046862B2

(12) United States Patent
Eisermann et al.

(10) Patent No.: US 8,046,862 B2
(45) Date of Patent: Nov. 1, 2011

(54) DRAIN CLEANING APPARATUS WITH ELECTRONIC CABLE COUNTER

(75) Inventors: Philip Eisermann, Winnabow, NC (US); Michael J. Rutkowski, Brunswick, OH (US)

(73) Assignee: Emerson Electric Co., St. Louis, MO (US)

( * ) Notice: Subject to any disclaimer, the term of this patent is extended or adjusted under 35 U.S.C. 154(b) by 714 days.

(21) Appl. No.: 12/188,433

(22) Filed: Aug. 8, 2008

(65) Prior Publication Data

US 2010/0031460 A1 Feb. 11, 2010

(51) Int. Cl.
*B08B 9/04* (2006.01)

(52) U.S. Cl. ..... 15/104.33; 33/732; 33/733; 33/743; 242/563.2; 254/134.3 FT

(58) Field of Classification Search ..... 15/104.31, 15/104.33; 33/732–736, 743, 746, 747; 242/563.2; 254/134.3 FT, 134.3 R; 324/207.24–207.26
See application file for complete search history.

(56) References Cited

U.S. PATENT DOCUMENTS

| | | | | |
|---|---|---|---|---|
| 2,468,490 | A | | 4/1949 | Di Joseph |
| 2,730,740 | A | | 1/1956 | O'Brien |
| 2,930,584 | A | * | 3/1960 | Hamrick et al. ..... 254/134.3 FT |
| 3,007,186 | A | | 11/1961 | Olsson |
| 3,078,486 | A | * | 2/1963 | Casto et al. ..... 15/104.33 |
| 3,095,592 | A | | 7/1963 | Hunt |
| 3,134,119 | A | | 5/1964 | Criscuolo |
| 3,246,354 | A | | 4/1966 | Cooney et al. |
| 3,394,422 | A | | 7/1968 | Siegal |
| 3,585,076 | A | * | 6/1971 | Prange ..... 134/113 |
| 4,092,780 | A | * | 6/1978 | Trethewey et al. ..... 33/762 |
| 4,364,139 | A | | 12/1982 | Babb et al. |
| 4,540,017 | A | | 9/1985 | Prange |
| 4,546,519 | A | | 10/1985 | Pembroke |

(Continued)

FOREIGN PATENT DOCUMENTS

WO 2008/079702 7/2008

OTHER PUBLICATIONS

International Preliminary Report on Patentability dated Nov. 23, 2010 in International Application No. PCT/US2009/045089.

*Primary Examiner* — Mark Spisich
(74) *Attorney, Agent, or Firm* — Rankin, Hill & Clark LLP

(57) ABSTRACT

A drain cleaning machine with an electronic cable counter is disclosed which is of the character comprising a frame supporting a rotatable drum which is driven by a motor through an endless belt. The drum contains a flexible drain cleaning snake which is rotatable with the drum and axially displaceable into an out from the drum, and the frame supports a cable feeding device through which the cable extends and by which the cable is displaced into and out of the drum. An electronic cable counter is configured to count an amount of cable payed out from and retracted into the drum and includes first and second sensor portions mounted on the rotatable drum and a cable follower member, respectively to sense relative rotational movement therebetween. A process determines an amount and direction of relative movement therebetween and generates a signal representative of an amount of cable payed or retracted into the drum. A fixed receiver unit is mounted to the frame and includes a human readable display portion and a receiver portion configured to receive the signal generated from the processor portion.

20 Claims, 17 Drawing Sheets

U.S. PATENT DOCUMENTS

| | | | | |
|---|---|---|---|---|
| 4,580,306 | A | | 4/1986 | Irwin |
| 5,009,242 | A | | 4/1991 | Prange |
| 5,031,276 | A | | 7/1991 | Babb et al. |
| 5,199,129 | A | | 4/1993 | Salecker et al. |
| 6,009,588 | A | | 1/2000 | Rutkowski |
| 6,016,609 | A | * | 1/2000 | Donovan et al. ..... 33/756 |
| 6,056,218 | A | * | 5/2000 | Nanbu ..... 242/223 |
| 6,076,219 | A | | 6/2000 | Irwin |
| 6,269,547 | B1 | * | 8/2001 | Chuang ..... 33/733 |

* cited by examiner

DRAIN CLEANING APPARATUS WITH ELECTRONIC CABLE COUNTER

BACKGROUND

The present application relates to sewer cleaning machines and, more particularly, to improvements in sewer cleaning machines of the type having a flexible plumbers cable or "snake" with a bulk portion coiled within a rotatable drum from which a working portion of the snake is withdrawn and inserted into a pipe or sewer to be cleaned and by which the snake is rotated to achieve such cleaning. In one preferred form the improvement is an electronic cable counter configured to count an amount of cable payed out from or withdrawn into the rotating drum during use of the drain cleaning apparatus for specific jobs, over the life of the cable, and a time of use of the machine per job and overall and, in another form, the improvement is a drain cleaning apparatus in combination with such cable counter. It will be appreciated, however, that the invention may find application in related environments and in any application where a working member is carried in or on a rotating carrier member and wherein there is a need or desire to determine an amount of the working member payed from the rotating carrier member.

Drum type sewer cleaning machines of the type to which the present application is directed are well known and are shown, for example, in U.S. Pat. No. 2,468,490 to DiJoseph; U.S. Pat. No. 2,730,740 to O'Brien; U.S. Pat. No. 3,007,186 to Olsson; U.S. Pat. No. 3,394,422 to Siegal; U.S. Pat. No. 3,095,592 to Hunt; U.S. Pat. No. 3,134,119 to Criscuolo; U.S. Pat. No. 3,246,354 to Cooney, et al.; U.S. Pat. No. 4,364,139 to Babb, et al.; U.S. Pat. No. 4,580,306 to Irwin; U.S. Pat. No. 5,031,276 to Babb, et al.; and, U.S. Pat. No. 6,009,588 to Rutkowski, all of which are hereby incorporated by reference. As will be seen from these patents, it is known to provide a drum type sewer cleaning machine comprising a frame structure supporting a rotatable snake drum and a drive motor arrangement for rotating the drum, and to provide for the drum to be removable from the frame and drive arrangement to, for example, facilitate replacement of the drum with one containing a snake having a different diameter. It will also be seen from these prior art patents that such drum type sewer cleaning machines may include a snake feeding arrangement supported by the frame and by which the snake or cable is adapted to be axially displaced relative to the drum during use of the machine. In these feeding devices, typically, a set of stationary roller wheels are moved into selective engagement with the rotating cable. The wheels are held at an angle relative to the rotational axis of the cable to thereby axially urge the cable out from and into the rotating carrier member where it is stored.

Simple devices for monitoring the length of snake or cable material payed out from a sewer or drain cleaning machine are also known in the art, such as noted in U.S. Pat. No. 3,394,422 to Siegal, U.S. Pat. No. 4,546,519 to Pembroke, U.S. Pat. No. 4,540,017 to Prange, and U.S. Pat. No. 5,009,242 to Prange, hereby incorporated by reference. These patents are generally concerned with measuring the length of a cable displaced into a drain being cleaned. However, in these applications, the cable material in the sewer cleaning device is not rotated about its axis, and is not in the form of a helically wound snake. In addition, in a selected set of these patents, the cable counting device requires a direct physical contact with the drain cleaning cable which could in some circumstances cause the counting device to become contaminated by debris carried by the drain cleaning snake or cable. Thus, these devices are somewhat limited and, further, do not encounter the same problems as are encountered in connection with monitoring the displacement of such a rotating cable coiled inside a rotating drum.

Accordingly, there is a need for an electronic cable counter configured to count an amount of snake or drain cleaning cable payed out from or retracted into a rotating drum of an associated drain cleaning apparatus without the need to directly contact the snake or cable and while permitting drum rotation. There is a further need for a drain cleaning apparatus including a frame, a drum, a flexible drain cleaning cable, and an electronic cable counter configured to count the amount of snake or cable payed out from or retracted into the rotating drum of the apparatus.

There is an additional need for an electronic cable counter configured to count an amount of snake or drain cleaning cable payed out from or retracted into a rotating drum of an associated drain cleaning apparatus on a per job basis as well as on an overall or historical basis. There is a further need for a drain cleaning apparatus including a frame, a drum, a flexible drain cleaning cable, and an electronic cable counter configured to count the amount of snake or cable payed out from or retracted into the rotating drum of the apparatus on a per job basis as well as on an overall or historical basis.

There is yet a further need for an electronic cable counter configured to count a time of use of the machine on a per job basis as well as on an overall or historical basis. There is a further need for a drain cleaning apparatus including a frame, a drum, a flexible drain cleaning cable, and an electronic cable counter configured to count the time of use of the machine on a per job basis as well as on an overall or historical basis.

SUMMARY

The present application provides, in a first aspect, a drain cleaning apparatus including a frame, a drum supported relative to the frame for rotation about a first axis, a flexible drain cleaning cable carried by and rotatable with the drum, a cable follower member configured to engage the cable and supported for relative movement with the drum, and an electronic cable counter configured to count an amount of cable payed out from the drum. The drum includes a main housing portion defining an opening therethrough. The cable is axially displaceable outwardly of the drum through the opening to pay out portions of the cable from the drum while bulk non-used portions of the cable remain stored in the drum. The cable is further axially displaceable inwardly of the drum through the opening to retract portions of the cable into the drum for storage when not in use. The cable follower member is configured to engage the cable and is supported for movement in a first direction relative to the drum as the snake is payed out of the drum and in a second direction relative to the drum as the snake is retracted into the drum. The electronic cable counter includes first and second sensor portions on the drum and cable follower member, respectively, for sensing the relative movement between the drum and the cable follower member in the first and second directions. A processor is in operative communication with the first and second sensors for detecting an amount of the cable payed out from the drum and for generating a signal representative of the detected amount.

In another aspect, the present application provides an electronic cable counter adapted for use with an associated drain cleaning apparatus of the type including a frame, a drum supported relative to the frame for rotation about a first axis, a flexible drain cleaning cable or snake carried by and rotatable with the drum, and a cable follower member configured to engage the snake and support it for relative movement with the drum in a first direction as the snake is payed out of the drum and in a second direction as the snake is retracted into the drum. The electronic cable counter includes a first sensor portion disposed on the drum and a second sensor portion disposed on the cable follower member. The first and second sensor portions sense relative movement between the drum and the follower member. A processor of the cable counter is in operative communication with the first and second sensor portions for detecting an amount of the snake payed out from the drum and for generating a signal representative of the detected amount.

In yet another aspect, the first sensor portion includes a magnet disposed in a first sensor housing carried on a one of the drum and the cable follower member. The second sensor portion includes a reed switch disposed in a second sensor housing carried on the other of the drum and the cable follower member.

In a further limited aspect, the processor is disposed in a one of the first and second sensor housings.

Still further, in another aspect, the electronic cable counter includes a display device including a display configured to display information readable by a human operator of the drain cleaning apparatus, and a signal transmission portion configured to transmit the signal representative of the amount of cable payed out the from the drum from the processor to the display device.

In accordance with a further aspect, the signal transmission portion includes a radio frequency (RF) link configured to transmit the signal from the processor to the display device. The display device includes a display housing mounted in a fixed relationship relative to the frame of the associated drain cleaning apparatus.

In accordance with a further limited aspect, the signal transmission portion includes a one of an infrared (IR) link and a slip ring link configured to transmit the signal from the processor to the display device.

In yet another aspect, the first and second sensor portions include a one of first and second optical sensor portions, first and second infrared (IR) sensor portions, and hall-effect sensor portions for sensing the relative movement between the drum and snake follower member in the first and second directions.

One advantage of the apparatus described in the present application is that a working length of a pipe cleaning cable is measured and displayed without the need for direct physical contact with the cable by the operator.

Another advantage of the apparatus described is that the working length of the pipe cleaning cable is measured and displayed while the bulk cable and non-working portion thereof is rotated during use of the drain cleaning apparatus.

The above and other aspects and advantages of the present application will become apparent to those of ordinary skill in the art upon a reading and understanding of the enclosed specification.

DETAILED DESCRIPTION

Figure 1:
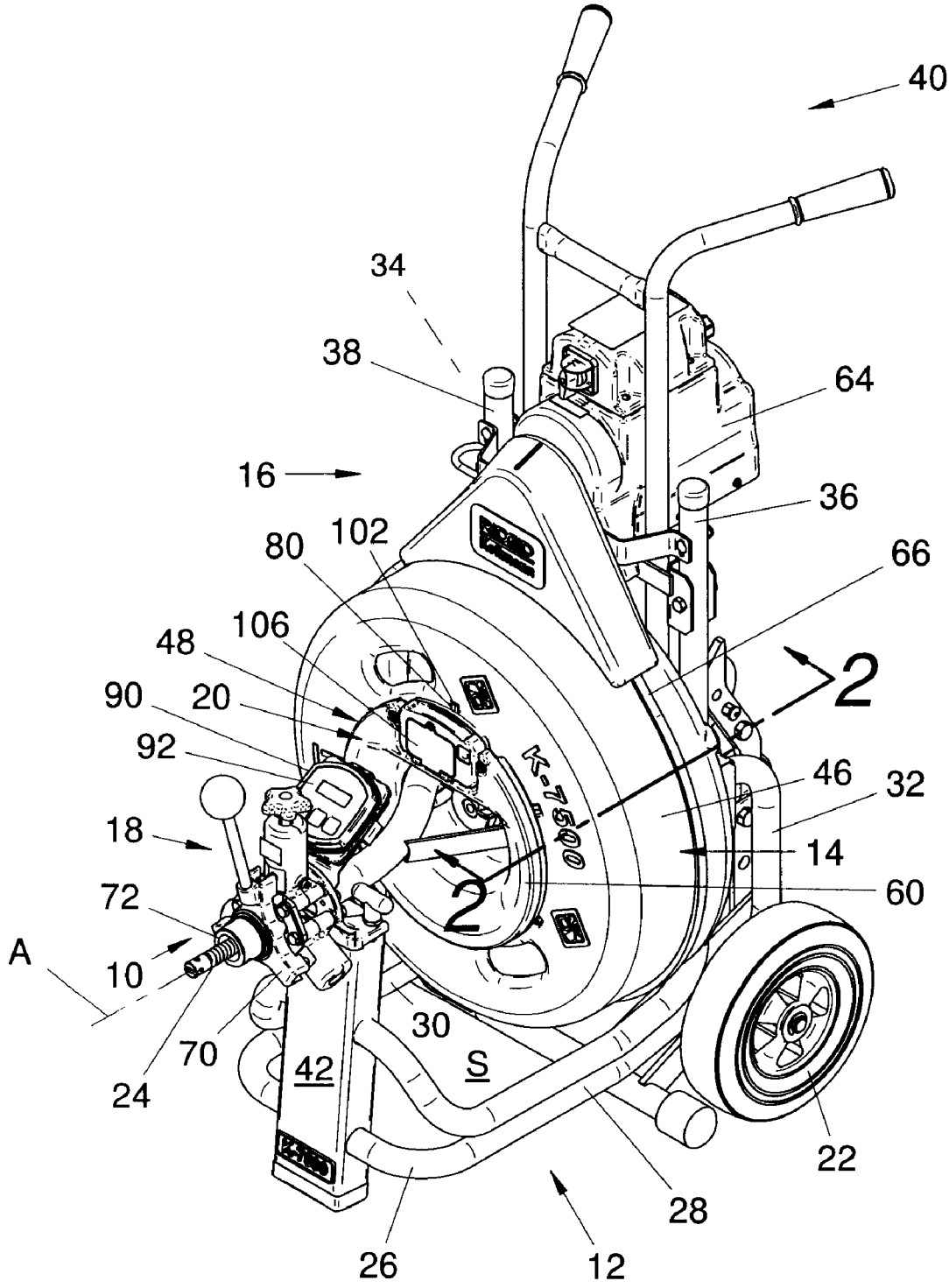
FIG. 1 is a perspective view of a drain cleaning apparatus with an electronic cable counter in accordance with a first embodiment.

The present invention relates to a drain cleaning apparatus or like device using an extendable flexible member which is typically administered into a piping system to remove or otherwise fragment blockages in the system so that fluid flow can be restored. The invention provides a system for measuring the length of the flexible member that is extended from the device. Preferably, the system is an electronic system in which data associated with relative revolutions of an inner and an outer drum of a drain cleaning apparatus are measured. Most preferably, the system utilizes a wireless communication link to transmit at least a portion of the data.

In one aspect, the present invention electronic system includes one or more sensor assemblies that are mounted on an inner drum, and one or more sensor assemblies that are mounted on a corresponding outer drum. Examples of suitable sensor assemblies include for example, magnets and corresponding magnetic pickups or like sensors. One of these is affixed to a rotatable inner and/or outer drum, and the other is affixed to a frame or support assembly of the device. The components are positioned such that as a drum rotates, a magnet affixed thereto passes its corresponding pickup. With each pass between a magnet and a pickup, a signal is transmitted from the pickup to an electronic counter device as known in the art. Preferably, a set of sensors are provided for the inner drum, and a set of sensors is provided for the outer drum. The electronic counter can total the number of passes, and compare the relative number of rotations between the two drums to arrive at a value of the total length of the flexible member extended from the device.

Alternately, instead of mounting sensor(s) on the drums, components or sensors could be mounted on the shafts of such drums to sense rotation. For example, a disc with teeth or a series of apertures could be utilized which rotated in conjunction with its corresponding drum. It is also contemplated that these aspects could be combined with the previously noted magnets such that a disc with magnets is provided to rotate in conjunction with a corresponding drum.

In all of the embodiments described herein, resolution can be increased by using multiple sets or pairs of sensors, such as multiple magnets and multiple corresponding magnetic pickups. Each magnet is preferably equidistant from other magnets around the periphery of the drum or disc, for example. In this strategy, a single pickup can be used to detect passing of each of the magnets. It will be appreciated that multiple pickups could also be utilized.

With reference now to the drawings, wherein the showings are for purposes of illustrating the preferred embodiments of the invention only and not for purposes of limiting the invention, a portable drain cleaning apparatus 10 is shown in FIGS. 1-3*a* as comprising a wheeled frame assembly 12 supporting a rotatable snake drum 14, a drum driving arrangement 16, a cable feeding mechanism 18, and an electronic cable counter 20. Frame assembly 12 is provided with a pair of wheels 22 by which the machine 10 is adapted to be supported for wheeled movement from one location to another along an underlying surface S, and drum unit 14 contains a flexible plumbers snake or cable 24 which extends outwardly through the feed mechanism 18 and which is adapted to be rotated and displaced inwardly and outwardly relative to the drum unit while the electronic cable counter 20 determines an amount of cable 24 payed out from the drum or retracted into the drum during operation of the machine, and other operational parameters as set forth more fully hereinafter.

Frame assembly 12 is basically of tubular construction and includes a bottom member having a laterally extending leg 26 at the front end of the machine 10 and a pair of rear upwardly extending legs 28 and 30 terminating at the rear end of the machine in upwardly extending legs 32 and 34 (not visible), respectively. The rear portion of the frame assembly further includes a pair of upstanding legs 36, 38 respectively secured at their lower ends to legs 28 and 30, such as by welding. The upper ends of legs 36 and 38 are interconnected by a suitable handle system 40. The front of frame assembly 12 includes an upstanding channel-shaped member 42 which is notched adjacent its lower end to receive frame leg 26 and which is secured to the latter frame leg such as by welding.

Figure 2:
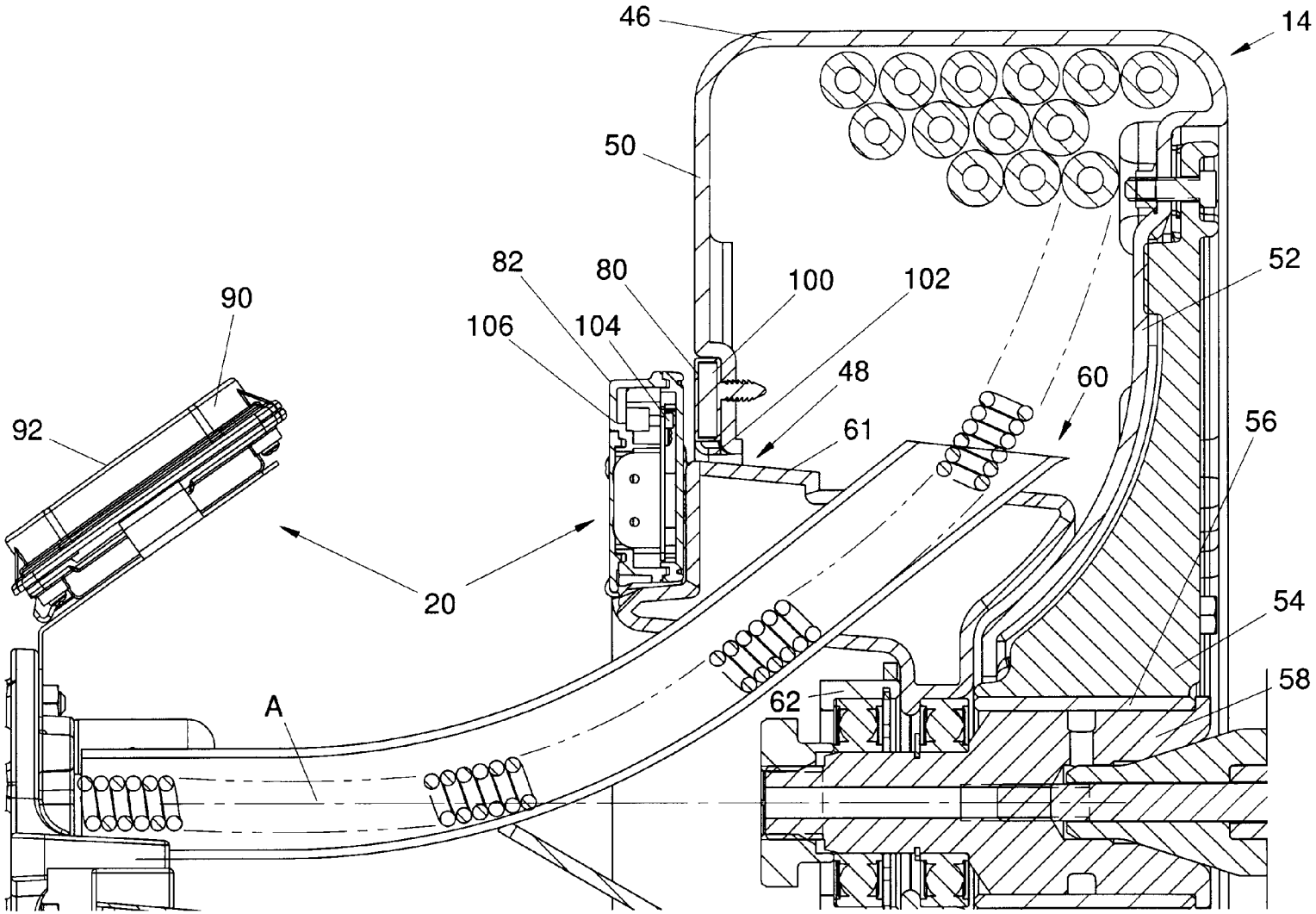
FIG. 2 is a partial cross-sectional view taken along line 2-2 of FIG. 1.

As best seen in FIGS. 1 and 2 of the drawings, the cable drum unit 14 includes a drum housing 46 having an opening 48 in a front wall 50 thereof and having its rear wall 52 contoured to receive a hub member 54 to which the housing is secured by means of a plurality of suitable fasteners or the like. The drum unit 14 further includes a hollow drum shaft 56 carried on an elongate member 58 secured to the frame 12 by which the drum shaft 56 and drum assembly 14 are rotatable about an axis defined by the elongate member 58. A cable follower member 60 preferably in the form of an inner drum 61 is secured to the outer end of the elongate member 58 for rotational displacement about its axis by means of a suitable mounting bracket 62 or the like using suitable bearings and fasteners. As is well known, the drum housing 46 holds the non-used section of the coiled cable member 24, and the cable follower member 60 serves to guide displacement of the cable into and out of the opening 48 and drum housing 46 while operating the drain cleaning apparatus 10 and in a manner which provides for the cable to be coiled and uncoiled during its displacement relative to the housing. While the cable follower member 60 is illustrated and described herein as being a part of the drum unit, this is merely a preferred arrangement and the guide tube could be supported adjacent its axially outer end for rotation, in which case it would be free of a mounted interconnection with the drum unit. Further, while the drum housing and hub are preferably separate components assembled as described herein above, the drum housing could be constructed so as to provide a hub portion integral therewith.

As best seen in FIG. 1 of the drawings, drum driving arrangement 16 includes an electric drive motor 64 which is adapted to drive an endless belt 66 which engages about the outer periphery of the drum housing 46 to achieve rotation of the latter. The cable feeding mechanism 18 is located on the upper end of the channel shaped member 42 and is located adjacent the axis of rotation A of the drum 14 and cable follower member 60 and includes a feed housing 70 having an opening 72 therethrough coaxial with the axis A and through which the cable 24 extends and about which both the drum housing 46 and the cable follower member 60 rotate. The cable feeding mechanism 18 includes a plurality of cam members and movable members which selectively engage the cable 24 as it rotates thereby drawing the cable from its coiled configuration within the drum 14 to pay out cable and, conversely, pushing the cable back into the drum 14 for storage of the non-used portion a coiled arrangement substantially as shown.

It is to be appreciated that the cable follower member 60 is movable relative to the drum housing 46. More particularly, it is rotatable about the axis A in a first direction relative to the drum housing 46 a manner corresponding with the unwinding of the cable 24 from its coiled configuration and, conversely, in a second direction relative to the drum housing 46 corresponding with the winding of the cable to restore it in its winded bulk storage configuration within the drum housing 46. The cable follower member 60 thus rotates one complete revolution relative to the drum housing 46 for each wrap or turn of cable taken from or restored into the bulk cable coiled within the drum housing 46 during use of the subject drain cleaning apparatus. This is easy to visualize when the drum 14 is stationary. However, this relationship also holds true when the drum 14 rotates during use of the drain cleaning apparatus 10. The electronic cable counter apparatus 20 utilizes this relationship and, generally, senses the relative rotational movement between the drum housing 14 and cable follower member 60 in order to detect relative rotational movement therebetween. The cable counter 20 further determines a direction of the relative rotational movement, determines an amount of relative rotational movement and, thus, an amount of cable payed from or retracted into the drain cleaning apparatus, and displays on a suitable human readable interface an amount of cable extending from the drain cleaning apparatus during use thereof. The cable counter further maintains a log of usage of the cable in a time of use measure and in a length of use measure. Each of these are maintained on a per job basis as well as on an overall aggregate or lifetime basis. In addition, the cable counter 20 is scalable for application in drain cleaning apparatus having drums 14 of various sizes.

Figure 3A:
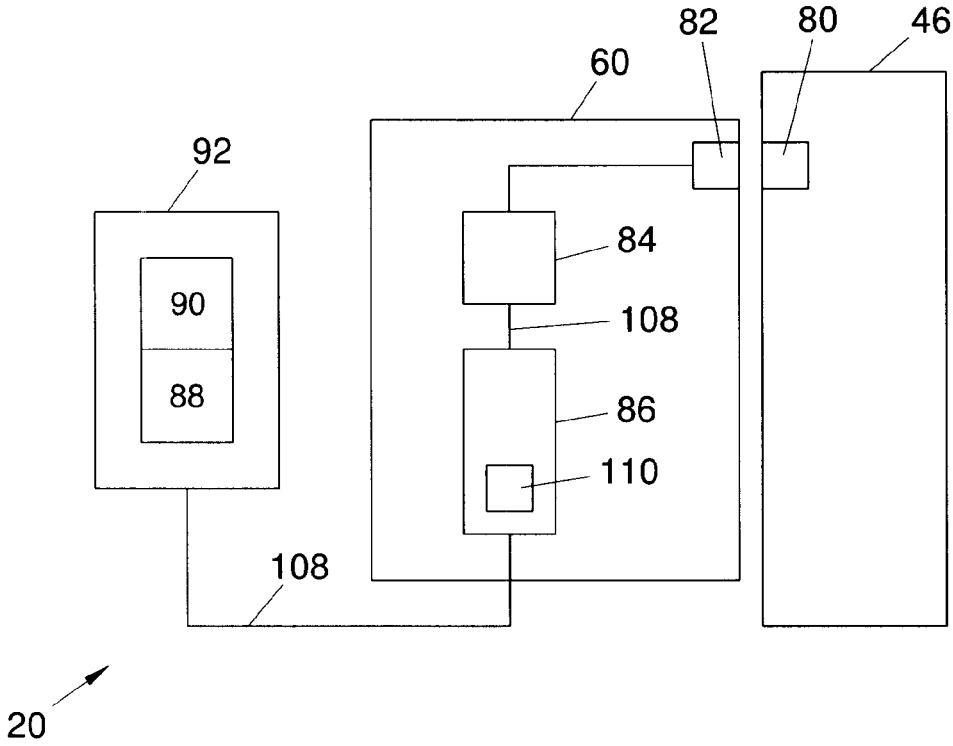
FIG. 3*a* is a schematic diagram of an electronic cable counter in accordance with a preferred embodiment and of the type shown in FIGS. 1 and 2.

In accordance with a first preferred form as shown in FIGS. 1, 2, and 3*a*, the electronic cable counter 20 includes, generally, a first sensor portion 80 mounted in a fixed relationship relative to the drum housing 46, a second sensor portion 82, mounted in a fixed relationship relative to the cable follower member 60, a processor 84 in operative communication with the first and second portions 80, 82 for determining an amount of said relative movement, a signal transmission portion 86 configured to transmit the signal from the processor to a receiver portion 88 having a human interface portion 90 with various input means and a readable display configured to generate human readable characters representative of the signal of the amount of cable payed from the drum generated by the processor 84 and other operating parameters of the apparatus as will be described in greater detail below.

In the first preferred form illustrated in FIGS. 1, 2, and 3*a* and as best shown in FIG. 2, the electronic cable counter 20 includes a set of magnets 100 disposed in a first sensor housing 102 carried on the drum housing 46 for relative rotational movement together with the drum housing about axis A. The second sensor portion 82 includes a corresponding set of Hall Effect sensors 104 disposed in a second sensor housing 106 carried on the cable follower member 60 for rotational movement together therewith about the axis A. In that way, the magnets 100 rotate together with the drum housing 46 while the Hall Effect sensors 104 rotate with the cable follower member 60 whereby the processor 84 (FIG. 3*a*) contained within the second sensor housing 106 senses pulses or switch closures as the magnets pass adjacent thereto during use of the subject drain cleaning apparatus. In addition, the signal transmission portion 86 includes a radio frequency (RF) link 110 configured to transmit a signal 108 generated by the processor 84 to the associated receiver portion 88. In the embodiment illustrated in FIGS. 1-3*a*, the RF link 110 is disposed in the second sensor housing 106 and, therefore, rotates together with the cable follower member 60 during use of the drain cleaning tool. In its preferred form, the RF link 110 includes an integrated circuit IC 112 connected with a suitably disposed wire loop or other antenna 114 (FIG. 7) disposed in or on the second sensor housing 106.

Figure 3B:
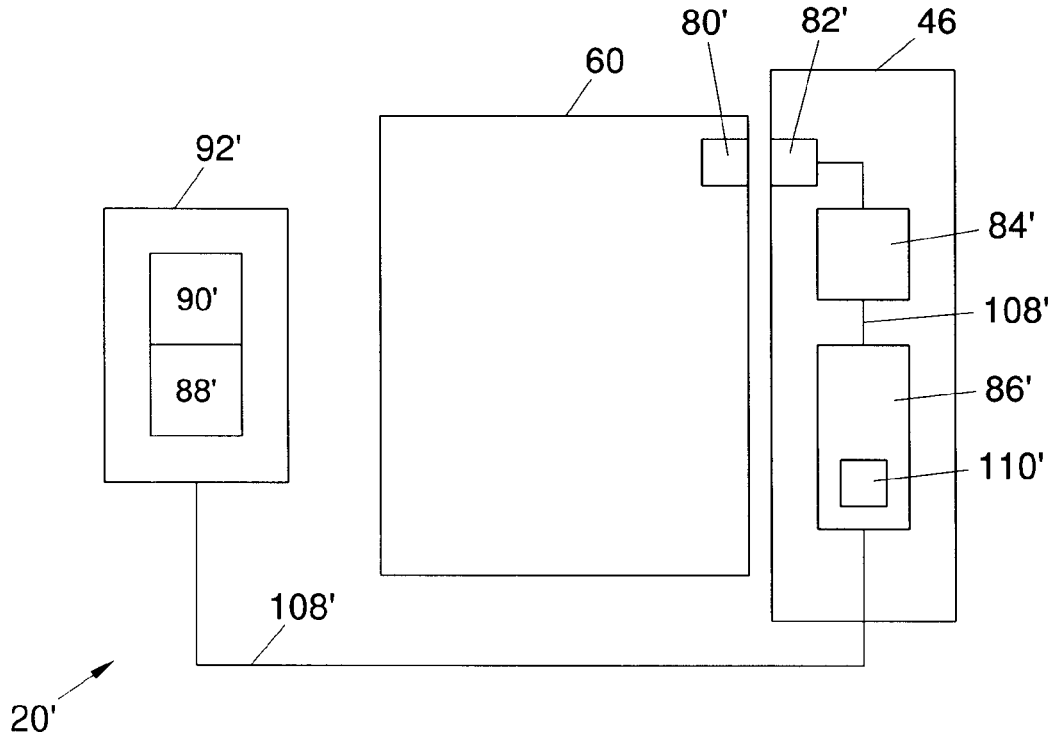
FIG. 3*b* is a schematic diagram of an electronic cable counter in accordance with a second preferred embodiment.
Figure 4:
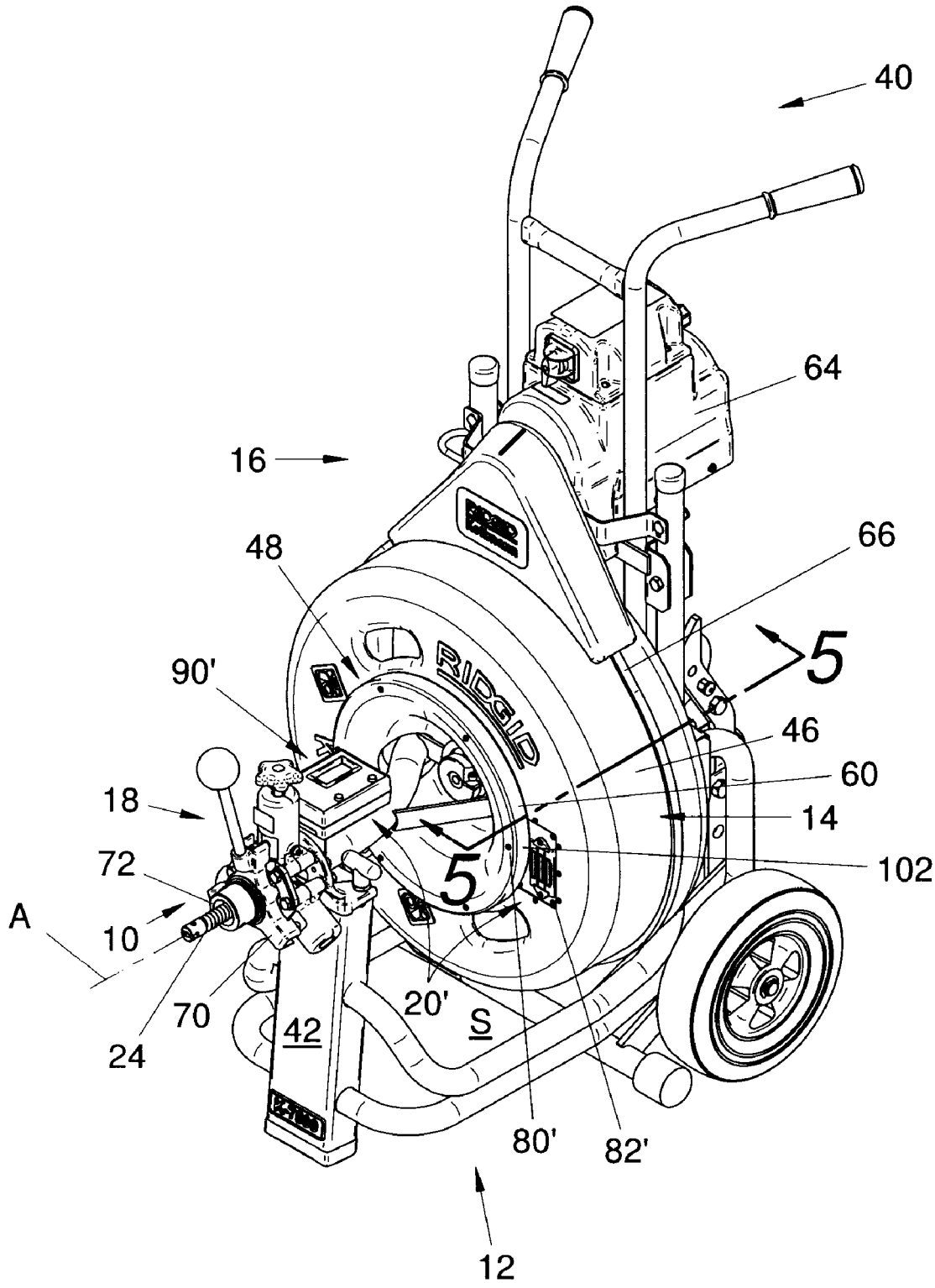
FIG. 4 is a perspective view of a drain cleaning apparatus with an electronic cable counter in accordance with the second preferred embodiment.
Figure 5:
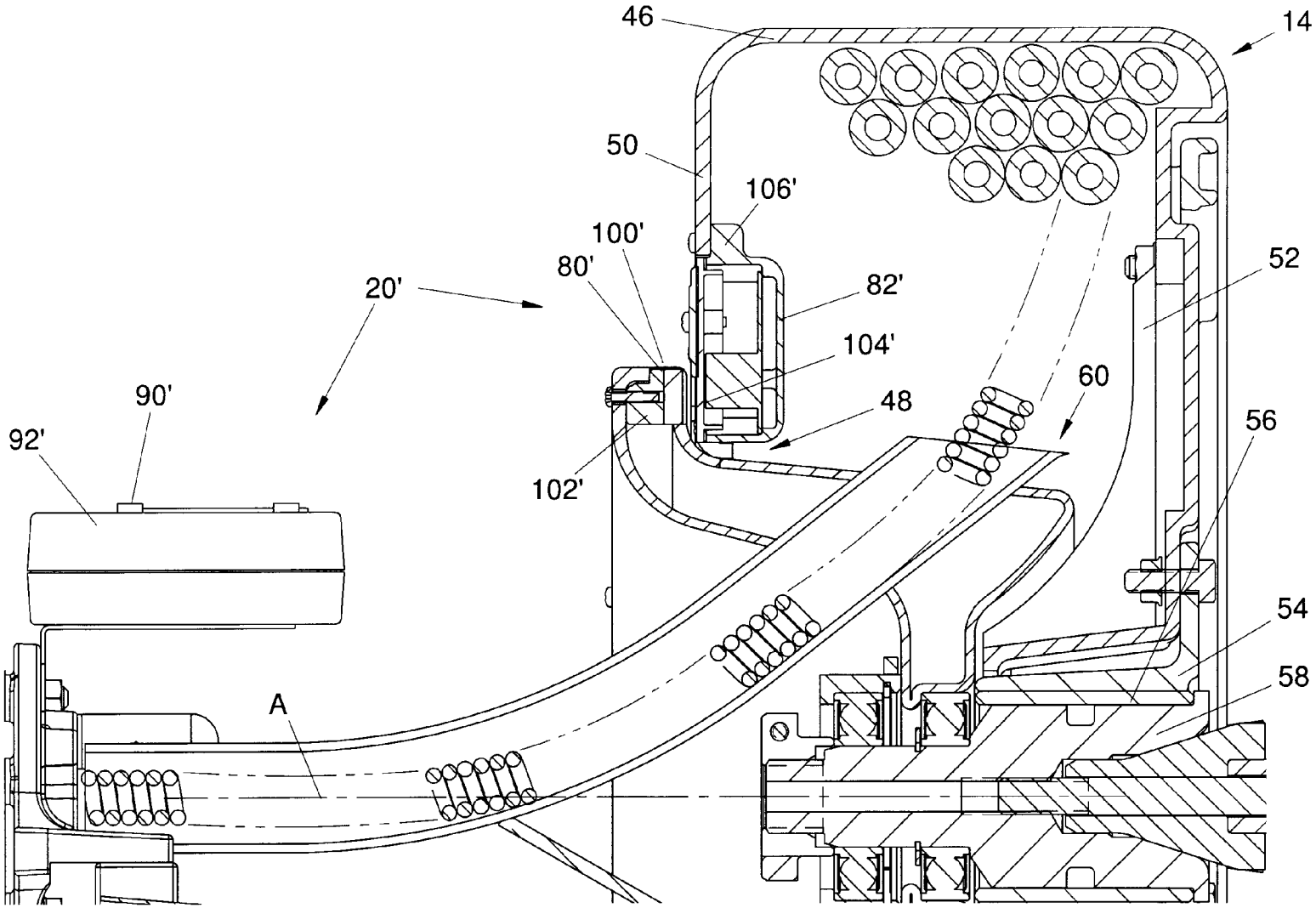
FIG. 5 is a partial cross-sectional view taken along line 5-5 of FIG. 4.

In a second preferred embodiment illustrated in FIGS. 3*b*, 4, and 5, similarly, the first sensor portion 80' includes a set of magnets 100' disposed in a first sensor housing 102' carried on the cable follower member 60. The second sensor portion 82' includes a corresponding set of sensors 104' disposed in a second sensor housing 106' carried on the rotatable drum housing 46. Preferably, for each magnet two sensors are provided. In certain embodiments, a total of six magnets are used. In a preferred embodiment, the processor 84' is disposed in the second sensor housing 106' and generates a signal 108' representative of the relative movement between the first and second sensor portions 80', 82' whereby the signal transmission portion 86' includes an RF link 110' configured to generate a radio frequency signal provided for reception by the receiver portion 88' carried in a housing 20' disposed on the frame 12.

In the first and second preferred embodiments illustrated in FIGS. 1, 2, 3*a* and 3*b*, 4, 5, respectively, the receiver portion 88, 88' and the human readable display portion 90, 90' are mounted in a fixed relationship relative to the frame 12 adjacent the cable feeding mechanism 18 in a suitable housing 92, 92'. This enables an operator to suitably adjust the cable feeding mechanism 18 while observing the human readable display portion 90, 90' which device is in convenient close proximity with the cable feeding mechanism 18.

It is to be appreciated that although the first and second sensor portions preferably include magnets and Hall Effect sensors, other sensor portions or technologies can be used as well such as, for example, optical sensor portions, infrared sensor portions, and other sensor portions for sensing the relative movement between the cable follower member 60 and the drum housing 46. And, as described herein, the sensors may utilize RFID tags. In addition, although the preferred form of the signal transmission portion 86 uses a radio frequency link 110, 110' in the preferred embodiments, other signal transmission portions can be used as well such as, for example, an infrared transmission portion and, one or more electromechanical slip rings or the like configured to transmit the signal 108 from the processor portion 84 to the receiver portion 88 for display on the human readable display portion 90.

Figure 6:
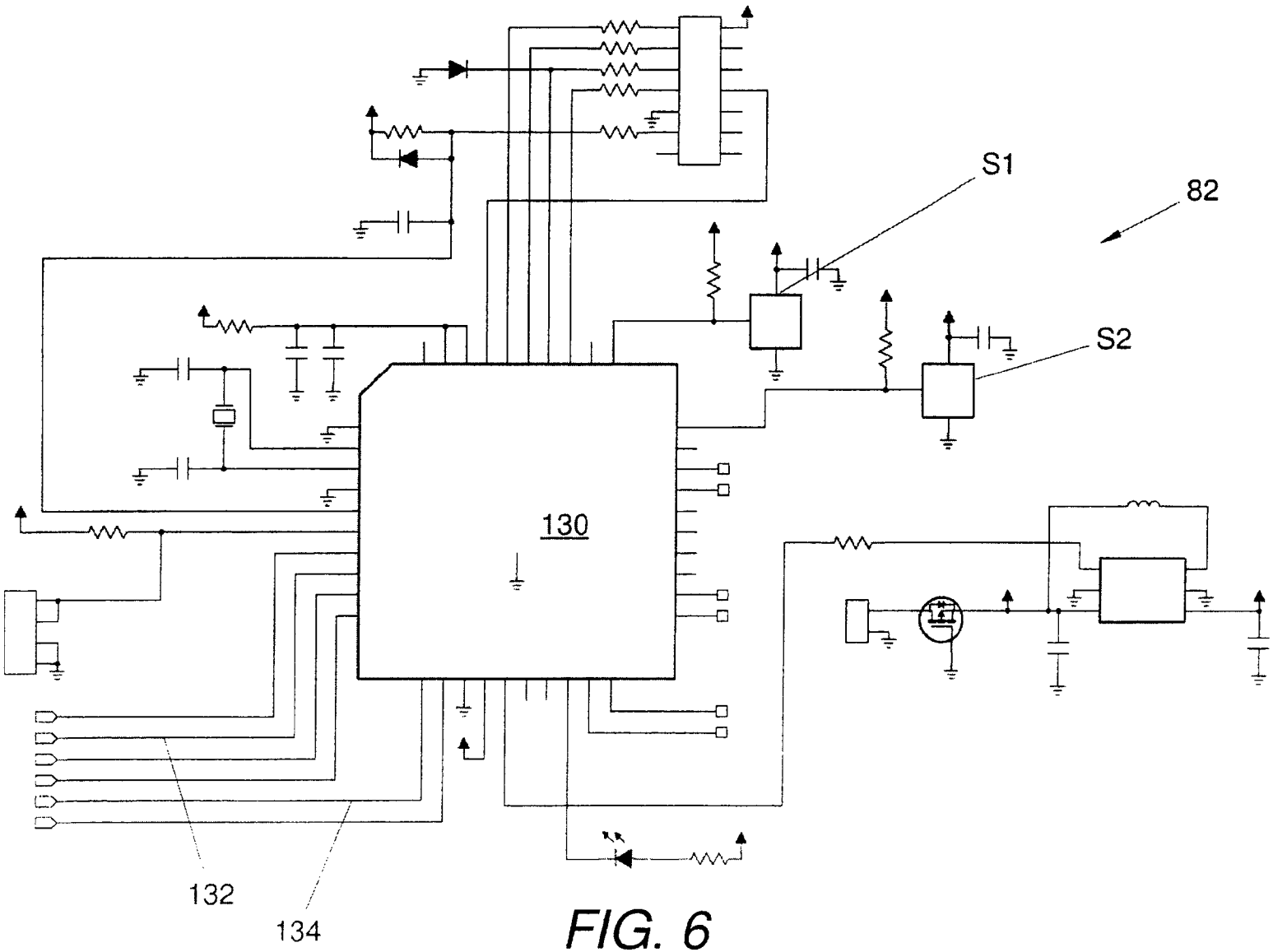
FIG. 6 is an electronic circuit diagram showing an input sensor and processor portion of the electronic cable counter circuits of FIGS. 3*a* and 3*b;*
Figure 7:
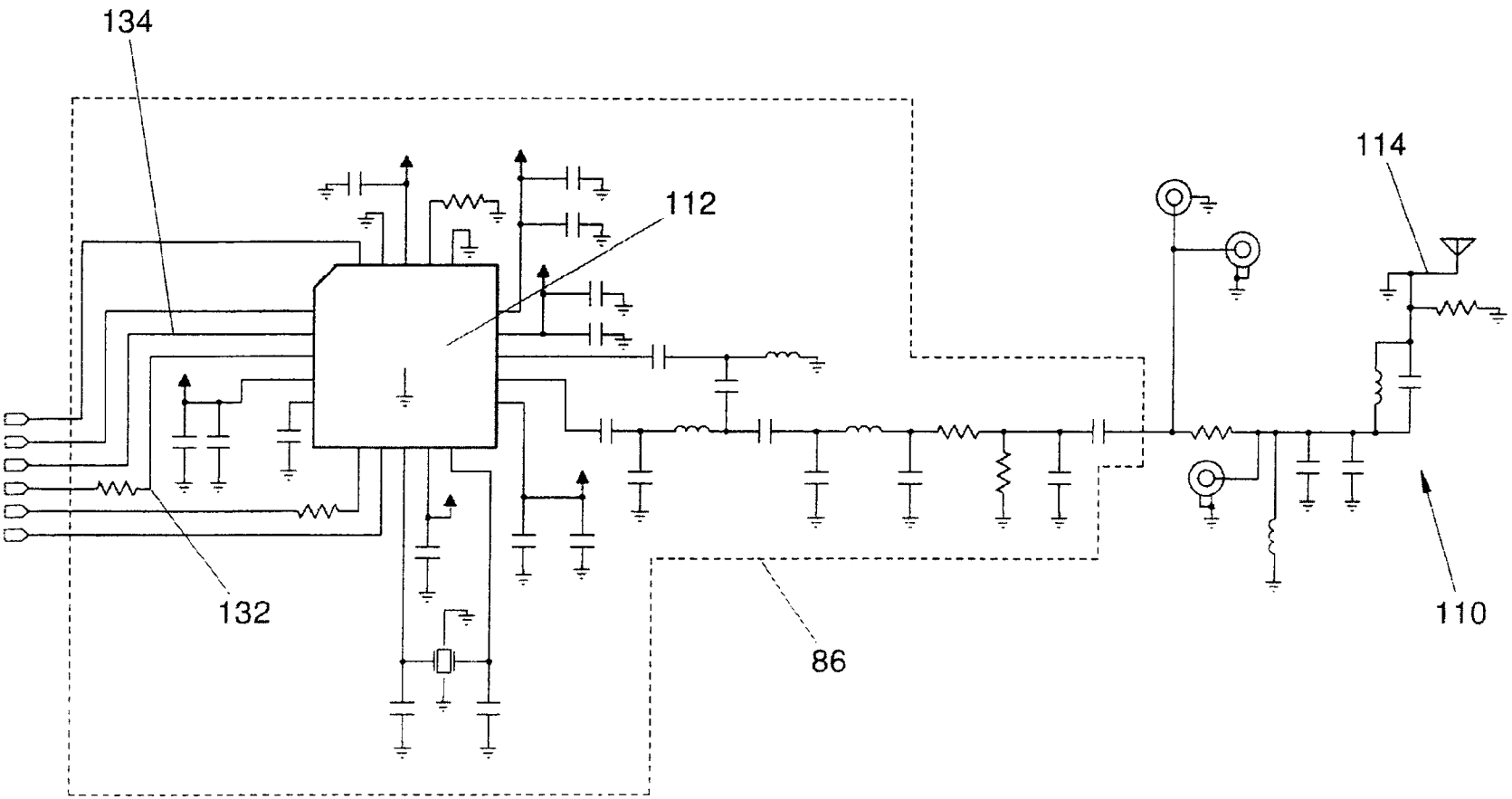
FIG. 7 is an electronic circuit diagram showing a transmitter/receiver portion of the electronic cable counter circuits of FIGS. 3*a* and 3*b* and coupled with the circuit of FIG. 6.

FIGS. 6 and 7 show electronic circuit diagrams of the components carried within the second sensor housing 106 in accordance with the preferred embodiment of the subject electronic cable counter 20. With reference first to FIG. 6, the second sensor portion 82 includes first and second switches S1, S2 in operative communication with a processor element 130. Preferably, the switch pair S1, S2 are low voltage, high sensitivity, bipolar hall switches, although other forms of switches may be used as well such as reed switches or the like. The preferred switches S1, S2 are commercially available from various suppliers under the designation US4881. Typically, these switches are normally opened and closed as the first sensor portions 80 pass in close proximity thereto. The processor element 130 shapes or otherwise forms the raw signals generated by the Hall Effect switches S1, S2 to generate a first signal such as depicted as 132 for example, representative of the direction of relative rotation between the cable follower member 60 and the drum housing 46. In addition, the processor element 130 generates a pulse signal such as depicted as 134 for example, representative of an amount of said relative rotational movement between the cable follower member 60 and the drum housing 46. In that way, the processor element 130 generates both direction and length signals 132, 134 representative of an amount of the cable 24 payed from or retracted into the drum housing 46 during use of the drain cleaning apparatus 10. In its preferred form, the processor 130 is a mixed signal microcontroller available from Texas Instruments under part number MSP430F2252IRHA, although other processors, microcontrollers, and/or discrete components can be used as desired.

FIG. 7 shows an electric circuit diagram of the signal transmission portion 86 of the subject electronic cable counter 20. The signal transmission portion 86 receives the direction signal 132 and pulse signal 134 into an integrated circuit 112 adapted to encode the direction and pulse signals onto a suitable carrier frequency for transmission to the receiver portion 88 (FIGS. 8 and 9) using well known electronic techniques. In its preferred form, the integrated circuit 112 is a low power radio frequency (RF) transceiver available from Texas Instruments under part number CC2500. Preferably, the circuit 112 is configured to transmit and receive RF signals at in the 2400-2483.5 MHz ISM (Industrial, Scientific and Medical) and SRD (Short Range Device) frequency band, and, more preferable, at 2.4 GHz. However, other transmission rates and modalities are possible as desired. A wire loop or another form of antenna 114 is provided using well known techniques to transmit the radio frequency signal from the RF link 110 portion of the transmission portion 86 into the space surrounding the electronic cable counter 20.

Figure 8:
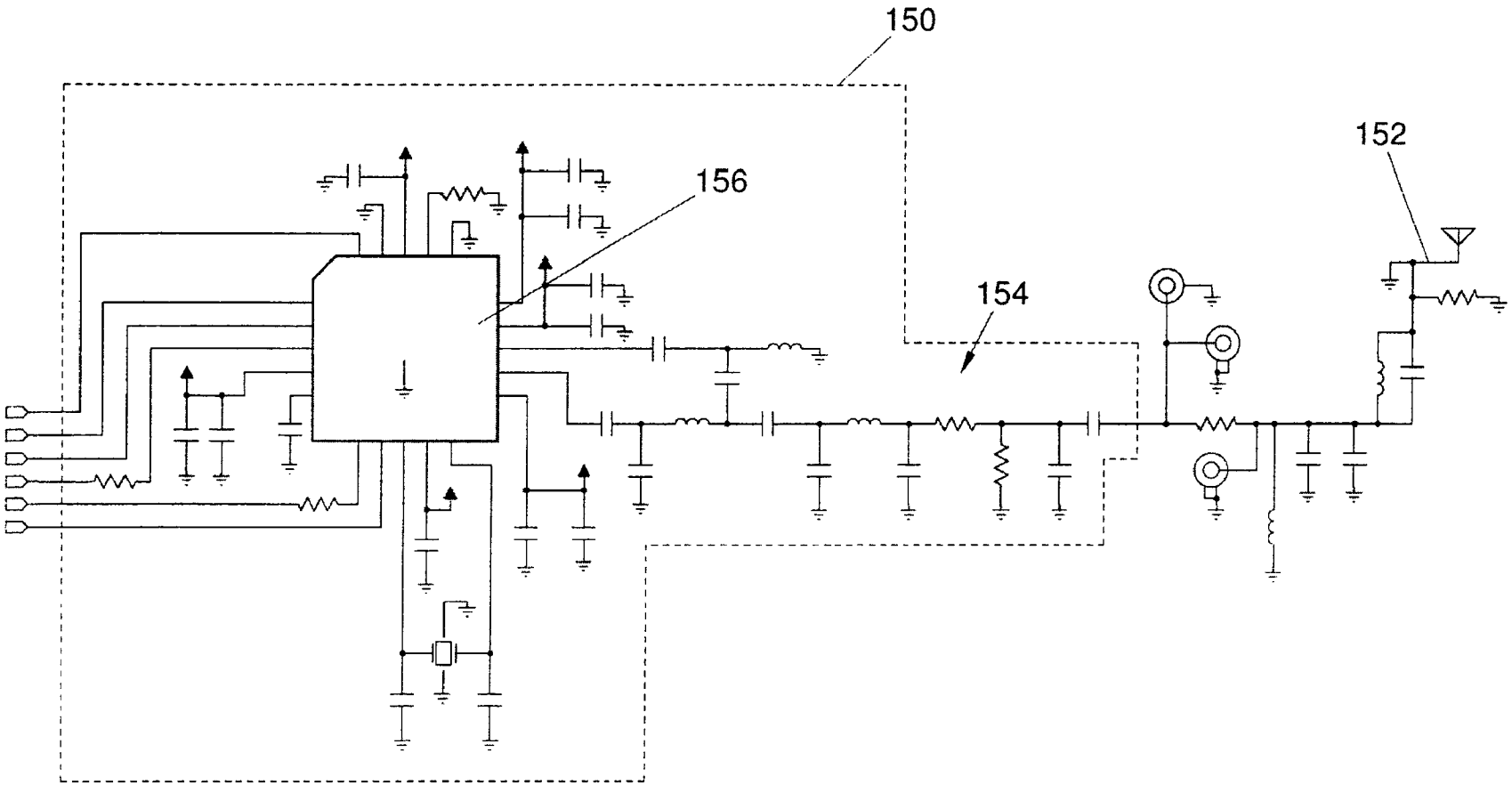
FIG. 8 is an electronic circuit diagram showing a transmitter/receiver portion of the electronic cable counter circuits of FIGS. 3*a* and 3*b* and coupled with the circuit of FIG. 9.
Figure 9:
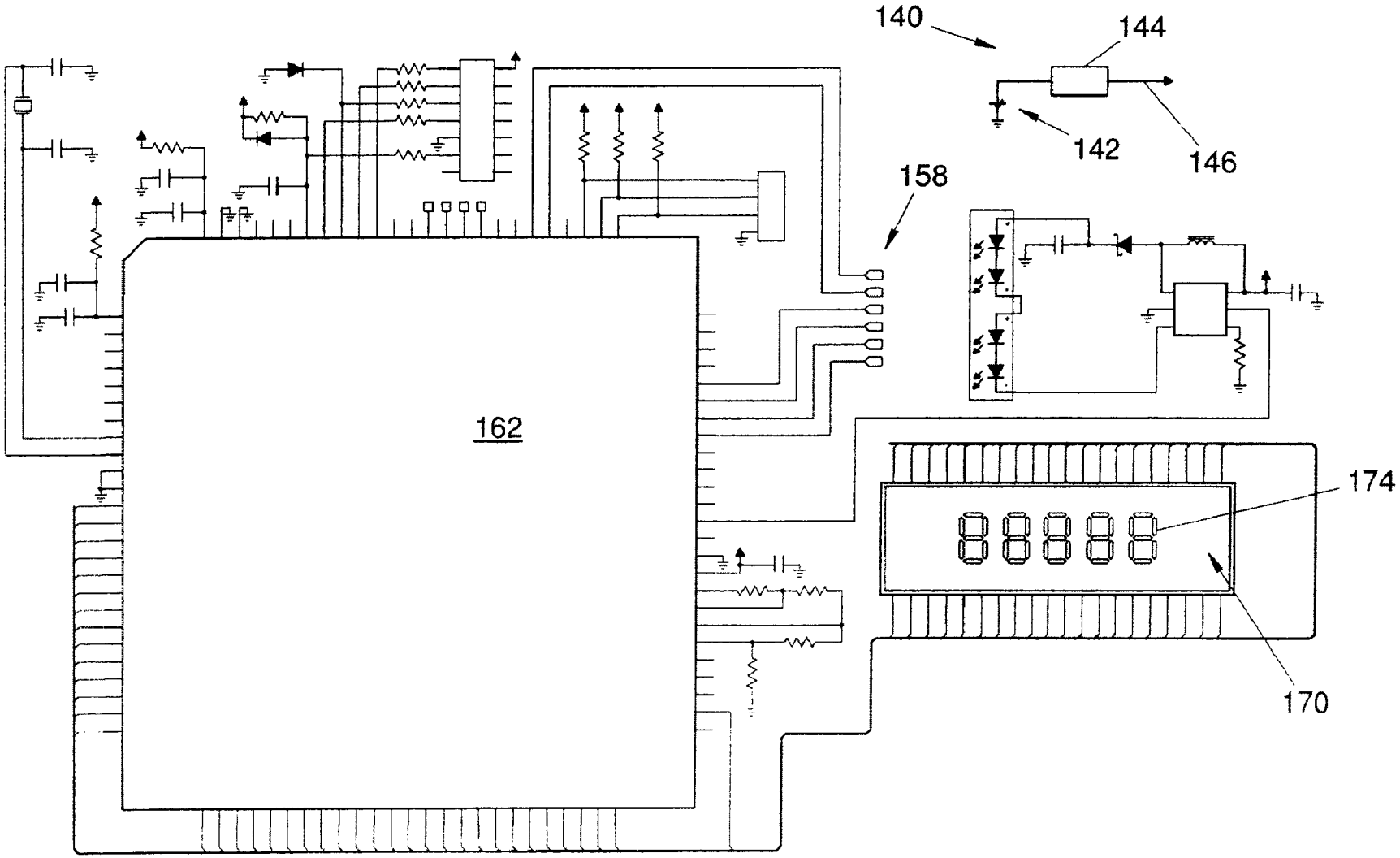
FIG. 9 is an electronic circuit diagram showing a processing portion of the electronic cable counter of FIGS. 3*a* and 3*b* and coupled with the circuit of FIG. 8.

FIGS. 8 and 9 show electronic circuit diagrams of the receiver portion 88 and human interface (readable display) portion 90 contained within the receiver housing 120 in accordance with the preferred embodiments. A power supply 140 includes a battery 142 connected with suitable electronics including a switching integrated circuit device in the form of a field effect transistor (FET) 144 and a voltage regulator (not shown 146) such as available from LinearTech at catalog number LTC3525LESC6. The power supply circuit 140 preferably generates a regulated 3 volt DC signal 146 for use in the processing portion 162 shown in FIG. 9. The signal reception portion 150 includes an antenna 152 configured to receive the radio frequency signal generated by the antenna 114 from the signal transmission portion 86. A saw filter 154 is interposed between the antenna 152 and a transceiver 156 in the form of an RF receiver CC2500 available from Texas Insruments. The RF receiver is surrounded by suitable support electronics arranged in a manner well known in the art.

FIG. 9 shows an electronic circuit diagram of the preferred form of the display driver portion of the subject electronic cable counter 20. As shown there, the display driver portion includes a further integrated circuit 162 in the form of a MSP430F4361IPZ microcontroller available from Texas Instruments. The integrated circuit 162 is configured to receive a display value signal such as depicted by 158 for example, generated by the transceiver 156 in the signal reception section for display in a human readable form on a display portion 170. Preferably, the display module 170 is in the form of a LCD-VI508-DP-FC-S-V100 five digit seven segment integrated driver and display module such as available from Varitronix. The display module 170 provides for display of one or more alpha-numeric characters or symbols 174.

Figure 10:
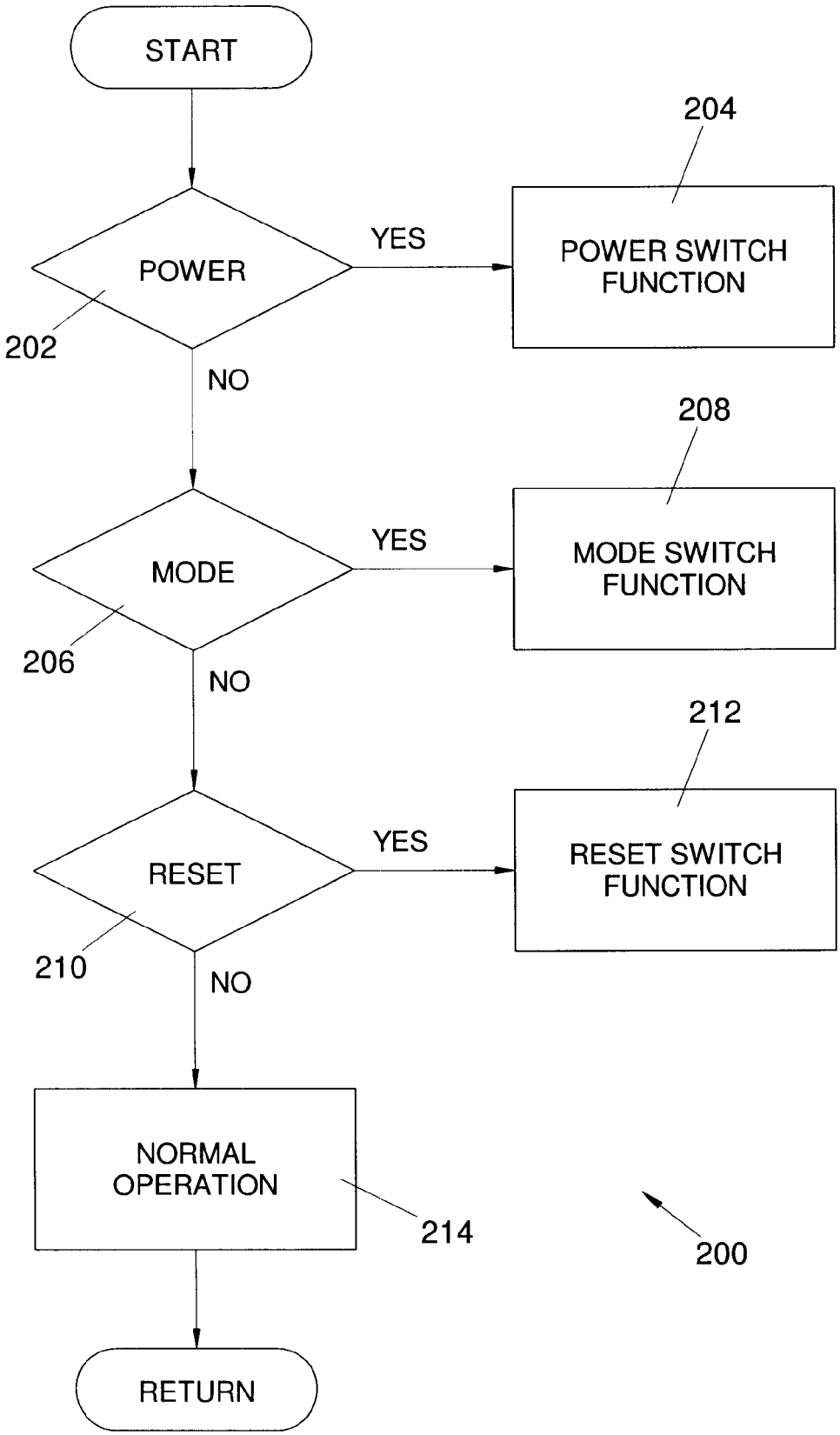
FIG. 10 is a flow chart illustrating a preferred control method of operating the subject device.
Figure 11:
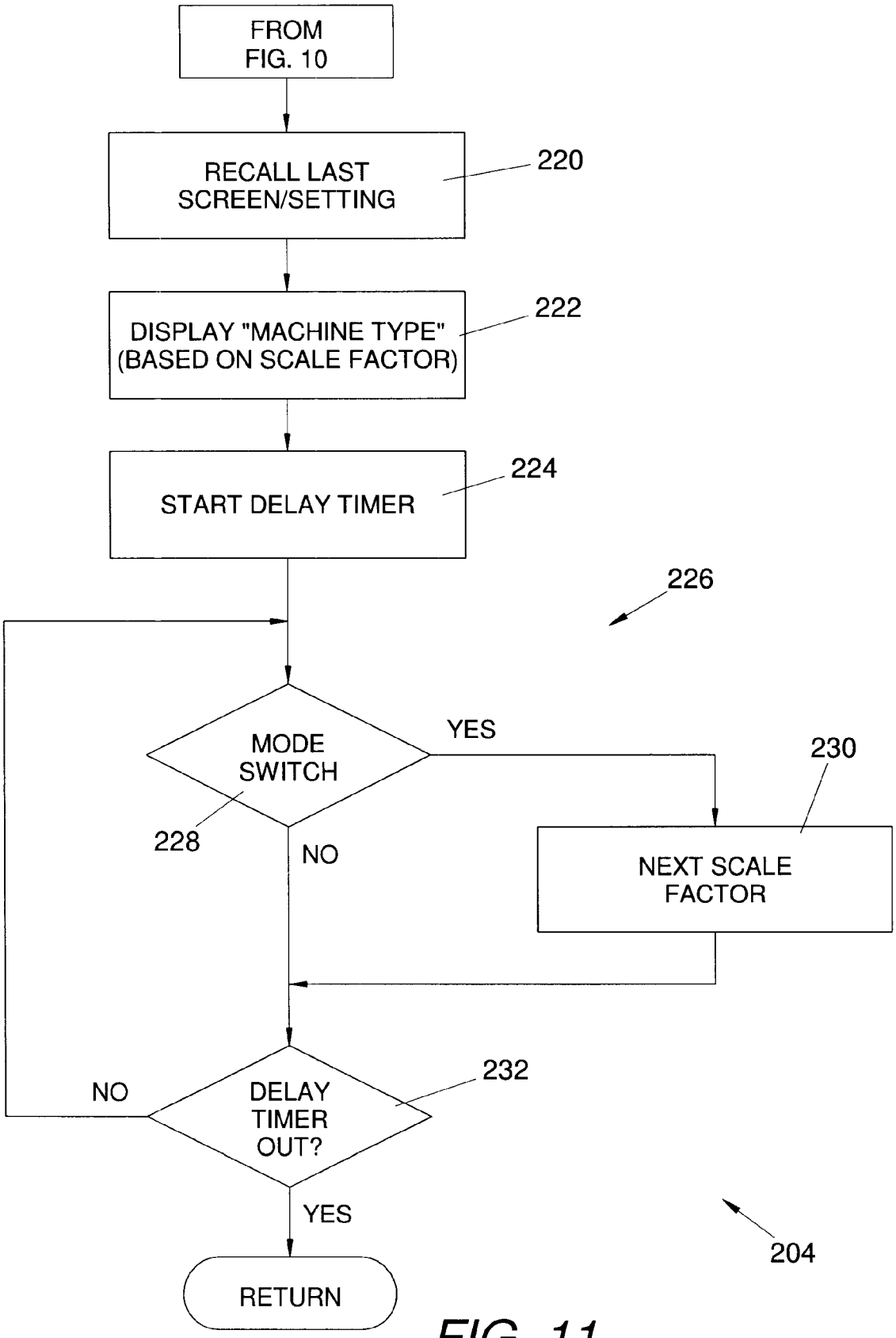
FIG. 11 is a flow chart illustrating a preferred subroutine of the control method of FIG. 10.
Figure 12:
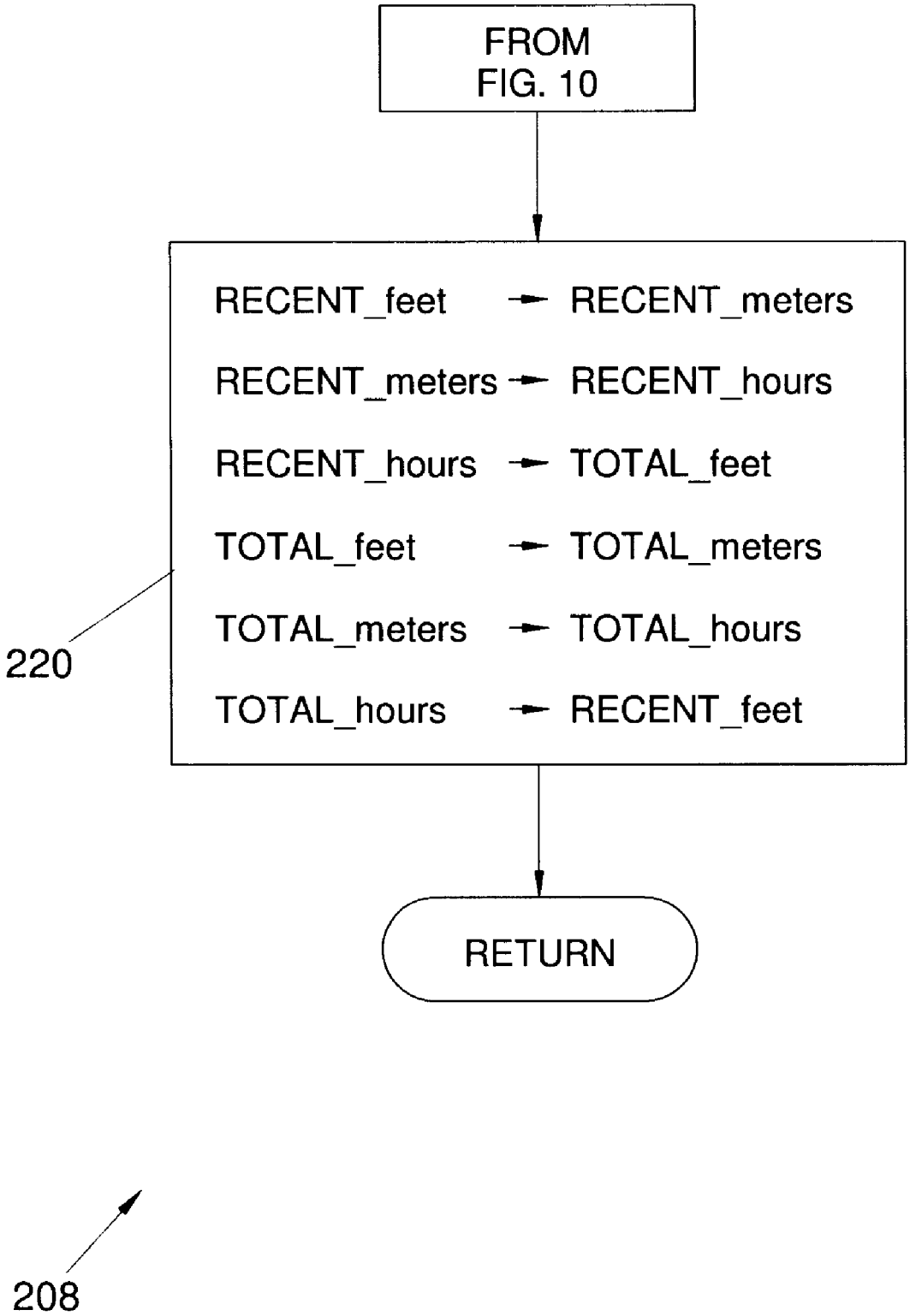
FIG. 12 is a flow chart illustrating a further preferred subroutine of the control method of FIG. 10.
Figure 13:
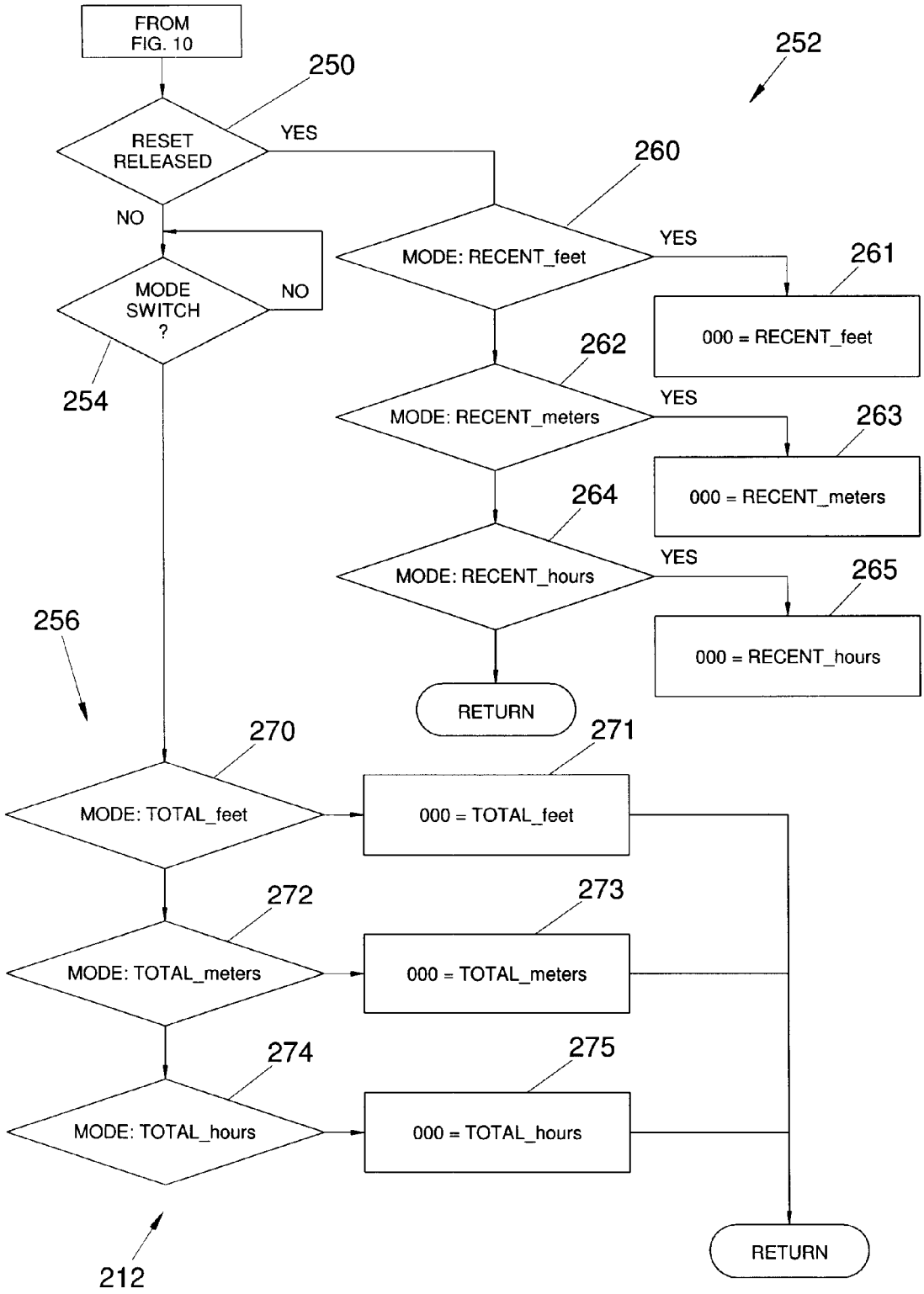
FIG. 13 is a flow chart illustrating yet a further preferred subroutine of the control method of FIG. 10.

Referring next to FIG. 10, a flow chart illustrating a preferred method 200 of operating the subject cable counter 20 in connection with the drain cleaning apparatus 10 shown by way of example will be described. FIGS. 11-13 are flow charts showing various subroutine steps executed in the overall method 200 of FIG. 10. More particularly, FIG. 11 is a flow chart illustrating the method steps executed in a power switch function 204 of the overall method 200. FIGS. 12 and 13 are flow charts illustrating a mode switch function 208 portion and a reset switch function 212 portion of the overall method 200, respectively. The method steps will be described with reference to FIGS. 14*a*-19*b* which show the human interface portion 92 of the subject cable counter 20 in various modes of operation corresponding to selected steps set out in FIGS. 10-13.

In step 202, the method 200 determines whether an operator of the subject device has actuated a POWER input switch 306 on an input area 304 of an operator interface panel 300 (FIGS. 14*a*-19*b*) provided on the receiver 90. Similarly, the method 200 detects in step 206 whether the operator has actuated a MODE input switch 308 on the input area 304. As well, in step 210, the method determines whether a human operator has actuated a RESET input switch 310 on the input area 304 of the operator interface panel 300. In the preferred basic function of the method 200, a power switch function 204 is executed when the power input switch 306 is actuated. Similarly, a mode switch function 208 is executed when an operator actuates the MODE input switch 308 and a RESET switch function 212 is executed when the operator actuates the RESET input switch 310. It will be understood that the sequence of steps or processing in any of the illustrated flow charts can be different.

Initially, the subject apparatus is initiated into a power on state by actuating the POWER input switch 306 whereupon the steps of the power switch function 204 shown in FIG. 11 are executed. The processor first recalls in step 220 the last screen displayed in step 222 on the output area 302 of the operator interface panel 300. A "machine type" is displayed on the output area 302 for purposes of alerting the user of a scale factor stored in the processor. As described above, the scale factor is used for purposes of scaling the counting of the relative rotational movement between the cable follower member and the drum housing. As noted above, the linear measure of cable paid from the drum is based on the circumference of the drum and, thus, its size. Accordingly, the subject preferred embodiment is configured to store a plurality of scale factors in the processor for purposes of adapting the subject device for use in a wide variety of drain cleaning apparatus of different sizes.

In step 224, a delay timer is initiated whereupon the power switch function method 204 enters into a delay loop 226 essentially waiting for the operator to actuate the MODE input switch 308. A test is performed at 228 to determine whether the operator actuated the MODE switch and, if so, the next scale factor is retrieved in step 230 from the processor and displayed on the output area 302 of the operator interface panel 300. However, if the delay loop 226 expires as determined by the delay timer test 232, the scale factor is not adjusted and the POWER switch function 204 returns to the overall control method 200 illustrated in FIG. 10.

Figure 14A:
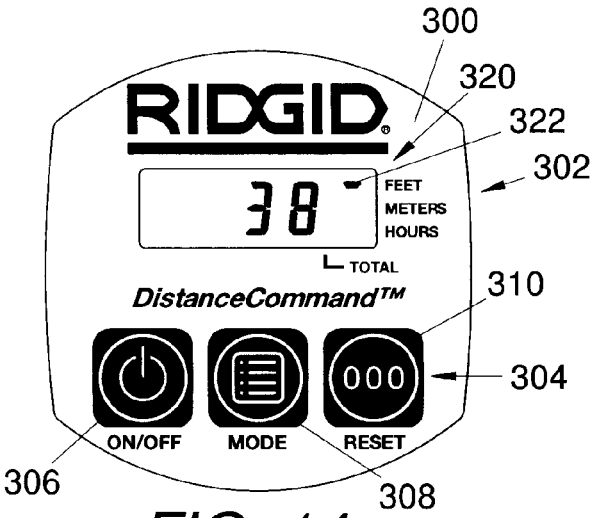
FIGS. 14*a*, 14*b* are schematic illustrations of the subject device in a RECENT_feet mode of operation.
Figure 15A:
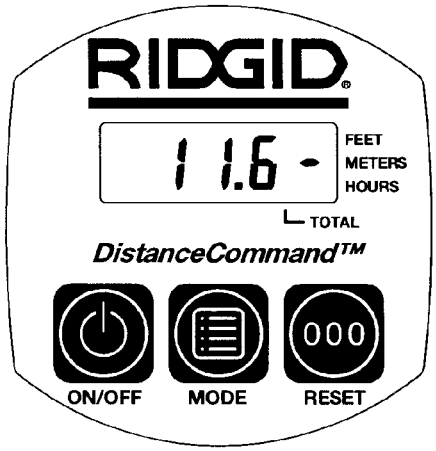
FIGS. 15*a*, 15*b* are schematic illustrations of the subject device in a RECENT_meters mode of operation.
Figure 16A:
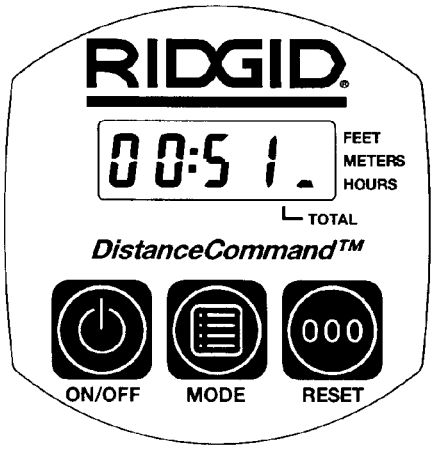
FIGS. 16*a*, 16*b* are schematic illustrations of the subject device in a RECENT_hours mode of operation.

In the event that the MODE input switch 308 is actuated by a user, the test 206 is satisfied whereupon the method 200 enters into the MODE switch function 208. With reference then to FIG. 12, the MODE switch function is configured to modify the mode state of the subject device between a plurality of predetermined states collectively depicted as 220. As shown in FIG. 14*a*, the output area 302 displays a value "38" and indicia 320 or other symbol or information such as in the form of a light bar 322. In the position shown in FIG. 14*a*, the light bar 322 is displayed in a position adjacent a legend indicative of a particular mode of operation of the subject device. More particularly, in FIG. 14*a*, the device is in a mode for displaying a linear measurement of the amount of cable 24 payed out from the device in units of feet. This is represented in FIG. 12 as "RECENT_feet." In this mode, as the operator actuates the MODE input switch 308, the MODE switch function 208 transitions from a RECENT_feet mode to a RECENT_meters mode which is displayed to the user on the output area 302 substantially as shown in FIG. 15*a*. A further actuation of the MODE input switch 308 transitions the subject device from a RECENT_meters mode to a RECENT_hours mode and displayed to the user substantially as shown in FIG. 16*a*. In the first two modes, the user of the subject device can simply read the output area 302 in order to determine an amount cable paid out from the machine and, ideally, routed into the working area such as a clogged drain or the like. In the third mode the user can read the time that the unit has been in use. This is convenient for the operator because the MODE input switch can be used to toggle the display area to show the amount of cable payed out in feet measure, metric measurement, and an amount of time that the device is in use.

Figure 17A:
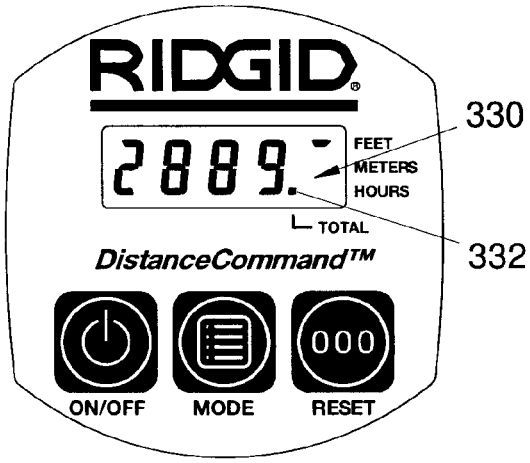
FIGS. 17*a*, 17*b* are schematic illustrations of the subject device in a TOTAL_feet mode of operation.
Figure 17B:
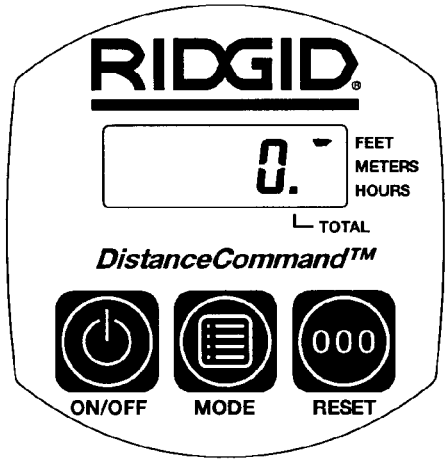
Figure 18A:
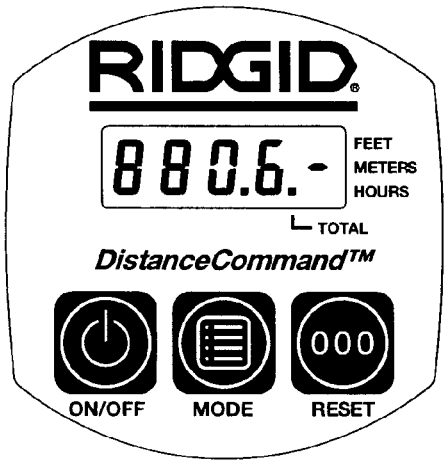
FIGS. 18*a*, 18*b* are schematic illustrations of the subject device in a TOTAL_meters mode of operation; and, FIGS. 19*a*, 19*b* are schematic illustrations of the subject device in a TOTAL_hours mode of operation.
Figure 18B:
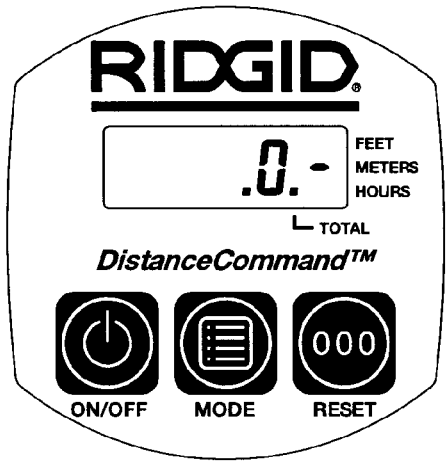
Figure 19A:
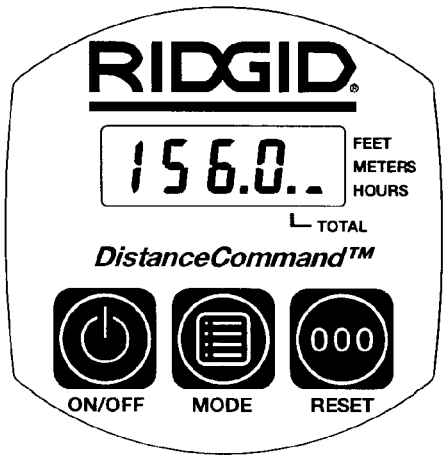

A further actuation of the MODE input switch 308 by the operator from a condition shown in FIG. 16*a* causes the device to transition from a RECENT_hours mode to a TOTAL_feet mode. As shown in FIGS. 17*a*-19*a*, a further indicia 330 is provided in the form of a dot 332 representative of the apparatus in an accumulated mode of counting and representation to the operator. More particularly, as shown in FIG. 17*a*, in the TOTAL_feet mode, the dot indicia 332 informs the operator that the numerical value "2889" displayed on the output area 302 is representative of an aggregate amount of linear measurement of cable payout during use of the device on a historical basis beginning at a predetermined point in time selected by the operator in a manner to be described in greater detail below. Similarly, FIG. 18*a* shows a representation of the TOTAL_meter mode indicating that the device paid out "880" meters of cable 24 from a particular point in time selected by the user. A further actuation of the MODE input switch 308 causes, as shown in FIG. 12, the subject device to toggle or otherwise transition from a TOTAL_meters mode to a TOTAL_hours mode such as shown in FIG. 19*a*. There, as shown, the subject device was in use a total of 156 hours from a predetermined selected point in time. Essentially, therefore, the mode of the subject device is selectable by actuating the MODE input switch 308 in succession to cause the device to transition substantially in sequence from FIGS. 14*a*, 15*a*, 16*a*, 17*a*, 18*a*, 19*a*, and back again to FIG. 14*a*.

Figure 14B:
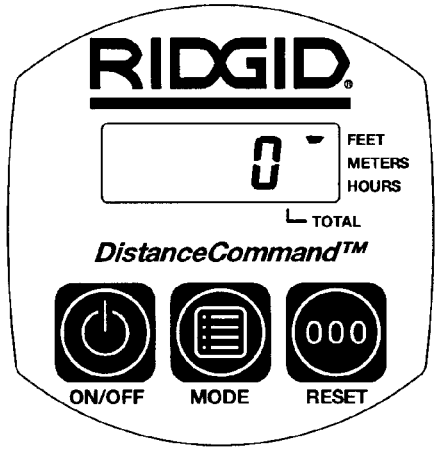
Figure 15B:
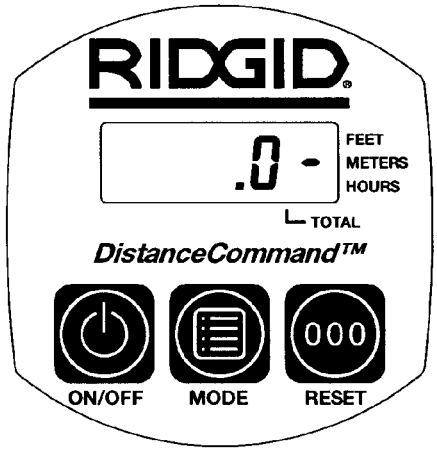
Figure 16B:
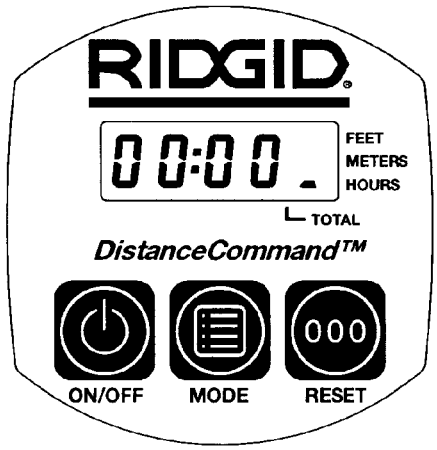
Figure 19B:
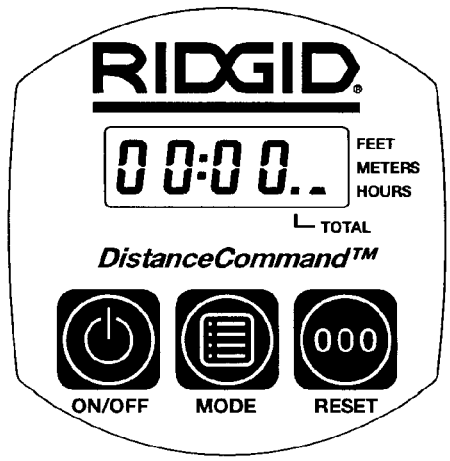

The parameter values accumulated and stored in the subject device can be reset by the operator as necessary or desired by actuating the RESET input switch 310. As shown in FIG. 10, the reset switch function 212 is initiated upon a test block 210 which receives the RESET input switch command. In FIG. 13, a test is made at step 250 whether the RESET input switch 310 is immediately released. If it is, the mode is adjusted substantially as shown in block steps 252 and as illustrated in FIGS. 14*b*, 15*b*, and 16*b*. However, if the RESET input switch 310 is not released as determined at step 250 and the unit is in the TOTAL_feet, TOTAL_meters, or TOTAL_time mode, and the MODE input switch 308 is actuated prior to releasing RESET input switch as determined at step 254, the step blocks at 256 are executed to adjust the mode of operation of the subject device substantially as shown in FIG. 13 and as illustrated in FIGS. 17*b*, 18*b*, and 19*b*. Essentially, the blocks 252 adjust the "short term" memory of the subject device while the blocks 256 adjust the "long term" memory of the device.

If it is determined at step 260 that the mode of the device is RECENT_feet, such as shown in FIG. 14*a*, the RECENT_feet parameter is reset at step 261 and as displayed in FIG. 14*b*. However, if the mode is RECENT_meters as determined at step 262, the parameter therefore is reset at step 263 and as illustrated in FIG. 15*b*. Lastly, if it is determined at step 264 that the mode of the device is RECENT_hours, the parameter is reset at step 264 and as displayed in FIG. 16*b*. Alternately, if the RESET input switch is actuated as determined at step 250 and the apparatus is in none of the first two modes identified immediately above, the RECENT_hours parameter is reset at step 265 and as illustrated in FIG. 16*b*.

When the operator actuates the RESET input switch simultaneously with the MODE input switch such as determined at steps 250 and 254, it is determined in step 270 whether the subject device is in a TOTAL_feet mode. Based upon that determination, the TOTAL_feet parameter is reset at step 271 and as shown in FIG. 17*b*. Similarly, as determined at step 272, when the apparatus is in a TOTAL_meters mode, the TOTAL_meters parameter is reset at step 273 and is illustrated in FIG. 18*b*. Lastly, as determined at step 274, when the apparatus is in a TOTAL_hours mode, the TOTAL_hours parameter is reset at step 275 and is shown in FIG. 19*b*. Alternately, when the subject device is in none of the first two above-noted "long term" memory modes, the TOTAL_hours parameter is reset at step 275 and as illustrated in FIG. 19*b*.

Figure 20:
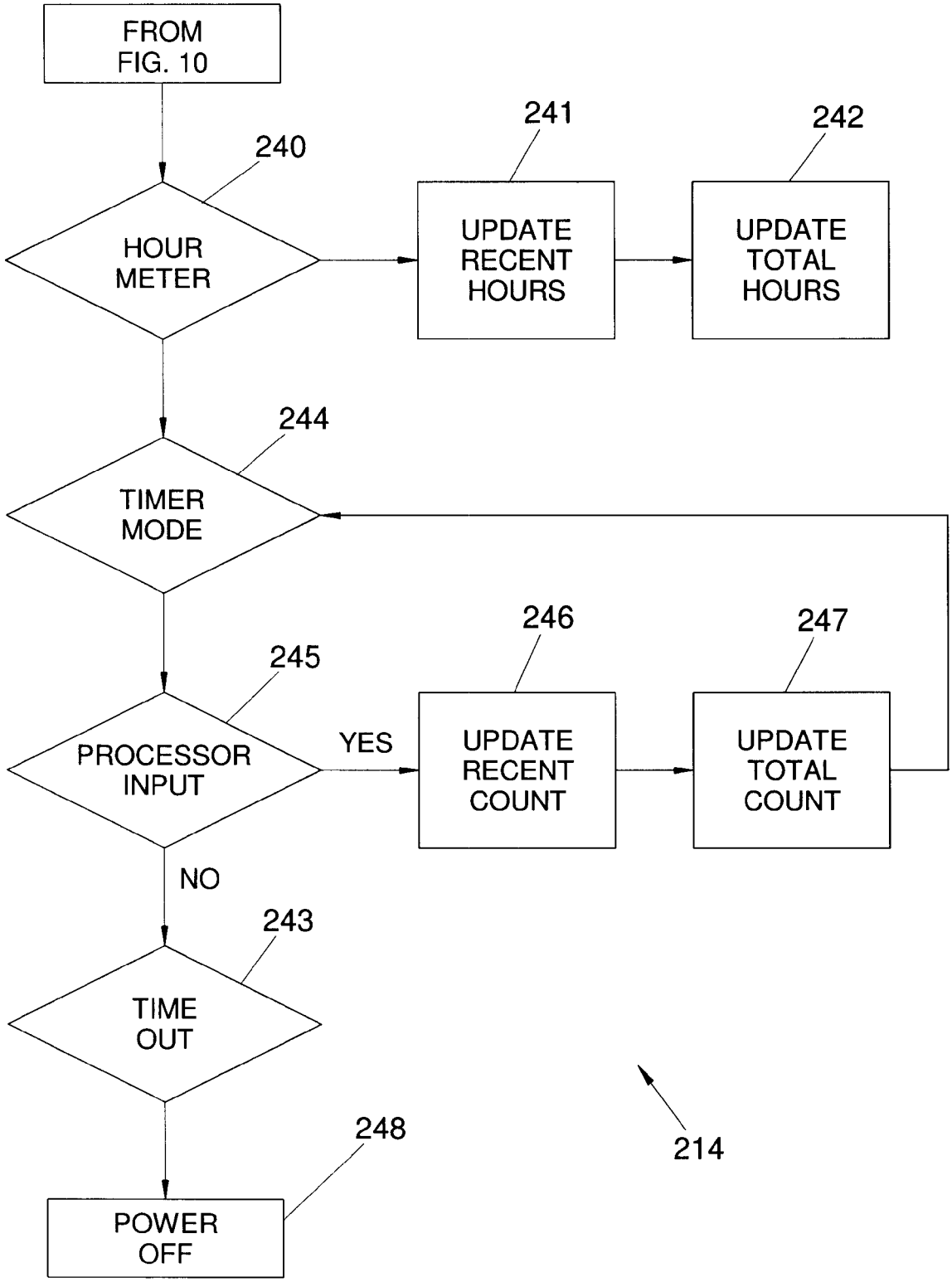
FIG. 20 is a flow chart illustrating a typical operation of the subject device.

FIG. 20 illustrates a typical normal operation 214 of the preferred apparatus in the overall method of FIG. 10. Upon initiation of normal operation 214 shown in FIG. 10, the hour meter function is initiated at 240 whereby cumulative updates for RECENT_hours and TOTAL_hours are determined and retained at blocks 241 and 242, respectively. The processor input 245 if registering a change in length signal, such as previously noted length signal 134, updates RECENT_feet and RECENT_meters and also TOTAL_feet and TOTAL_meters at blocks 246 and 247, respectively. Changes to these amounts reset a timer as depicted at block 244, thereby indicating that the apparatus is in use. If changes to these amounts do not occur, a time out signal is generated such as at block 243 whereby a power off 248 or shut down is initiated. For most applications, a time out signal is generated from block 243 after expiration of a period of from about 5 minutes to about 15 minutes, with 10 minutes being preferred. It will be understood that the present invention includes the use of time out time periods less than or greater than these amounts.

Figure 21:
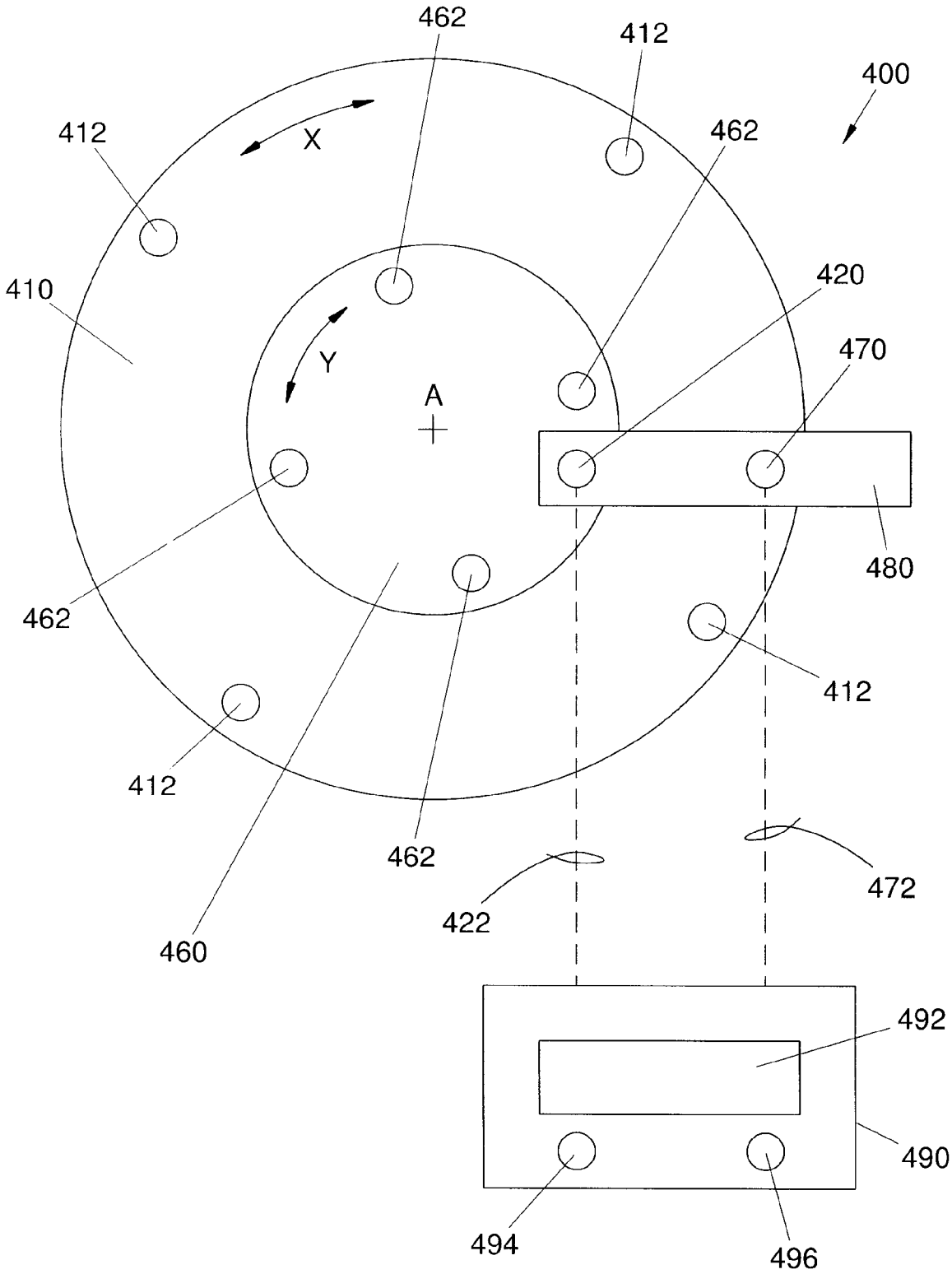
FIG. 21 is a schematic illustration of another preferred embodiment system.

FIG. 21 illustrates another preferred embodiment in accordance with the present invention. In this aspect, a system 400 comprising one or more magnets 412 are affixed to an outer drum 410 of a drain cleaning device as described herein. A corresponding magnetic pickup 470 is positioned on a support member 480 and located so as to register or sense a corresponding magnet 412 passing thereby as the drum 410 rotates. Outer drum 410 rotates in directions shown by arrow x, about an axis of rotation A. Similarly, one or more magnets 462 are affixed to an inner drum 460. A corresponding magnetic pickup 420 is positioned on the support member 480 and located so as to register or sense a corresponding magnet 462 passing thereby as the drum 460 rotates. Inner drum 460 rotates in directions y, about the axis of rotation A. Electronic signals 422 and 472 are transmitted from the pickups 420 and 470, respectively to an electronic processor and indicator module 490. The module 490 calculates relative rotations between the drums 410 and 460 and then indicates the corresponding length of flexible member or snake that has been paid out, at indicator 492. The module 490 may include a reset and/or power switch 494 and a calibration mode switch 496 to adjust the indication of cable length paid out, to a specific drain cleaning device. The signals 422 and 472 may be transmitted wirelessly, such as by RF or IR, or may be transmitted by cables between the pickups and the module.

In yet another aspect, the present invention includes the use of RFID tag(s) and reader(s) as the sensors for assessing rotation of either or both of the inner and outer drums. That is, in this preferred aspect, one or more radio frequency identification (RFID) tags are secured to the inner and outer drums, and one or more corresponding RFID reader(s) are used to sense the rotation(s) of each drum. A significant feature of this aspect is the relatively low cost and widespread availability of RFID tag systems.

Most RFID tags contain at least two parts. One is an integrated circuit for storing and processing information, modulating and demodulating a (RF) signal, and other specialized functions. The second is an antenna for receiving and transmitting the signal. Chipless RFID allows for discrete identification of tags without an integrated circuit, thereby allowing tags to be printed directly onto assets at a lower cost than traditional tags.

RFID tags come in three general varieties: passive, active, or semi-passive (also known as battery-assisted). Passive tags require no internal power source, thus being pure passive devices (they are only active when a reader is nearby to power them), whereas semi-passive and active tags require a power source, usually a small battery. To communicate, tags respond to queries from generated signals that should not create interference with the readers, as arriving signals can be very weak and must be differentiated. Besides backscattering, load modulation techniques can be used to manipulate the reader's field. Typically, backscatter is used in the far field, whereas load modulation applies in the nearfield, within a few wavelengths from the reader.

In a preferred embodiment, passive RFID tags are utilized. Passive RFID tags have no internal power supply. The minute electrical current induced in the antenna by the incoming radio frequency signal provides just enough power for the CMOS integrated circuit in the tag to power up and transmit a response. Most passive tags signal by backscattering the carrier wave from the reader. Typically, the antenna collects power from the incoming signal and also transmits the outbound backscatter signal. The response of a passive RFID tag is not necessarily just an ID number, the tag chip can contain non-volatile, possible writable EEPROM for storing data.

The preferred embodiment RFID tags and corresponding readers are commercially available from numerous sources such as, but not limited to Remote Identity of Erie, Colo.; Omni-ID of Menlo Park, Calif.; Sokymat S. A.; and Intermec Technologies of Everett, Wash.

Incorporating RFID tags into the preferred embodiment systems provides additional advantages over the use of magnets or like sensor sets. Since each RFID tag can be configured with a unique identifier, only a single reader is necessary. Thus a single RFID reader can be used to register movement, i.e. rotation, of RFID tags on both inner and outer drums. In addition, the RFID reader could be housed within the cable counter indicator module or other existing component of the drain cleaning apparatus.

All patents identified herein are incorporated by reference in their entirety.

It will be understood that one or more features of the various embodiments described herein can be used in combination with one or more other features of other embodiments described herein.

The exemplary embodiments have been described with reference to the preferred embodiments. Obviously, modifications and alterations will occur to others upon reading and understanding the preceding detailed description. It is intended that the exemplary embodiments be construed as including all such modifications and alterations insofar as they come within the scope of the appended claims or the equivalents thereof.

The invention claimed is:

1. A drain cleaning apparatus comprising:

a frame;

a drum supported relative to said frame for rotation about a first axis, the drum including a main housing portion defining an opening therethrough;

a flexible drain cleaning snake/cable carried by and rotatable with said drum, the cable being axially displaceable outwardly of said drum through said opening to pay out portions of the cable from the drum and being axially displaceable inwardly of said drum through said opening to retract portions of the snake into the drum;

a snake/cable follower member configured to engage said cable and supported for movement in a first direction relative to said drum as the cable is payed out of the drum and in a second direction relative to said drum as the snake is retracted into the drum; and, a snake/cable counter configured to count an amount of cable payed out from said drum, the cable counter including first and second sensor portions on the drum and cable follower member, respectively, for sensing relative movement between the drum and the cable follower member in said first and second directions, and a processor in operative communication with said first and second sensor portions for determining an amount of cable payed out from said drum and generating a signal representative of said amount.

2. The drain cleaning apparatus according to claim 1 wherein:

said first sensor portion includes a magnet disposed in a first sensor housing carried on a one of the drum and the cable follower member; and, said second sensor portion includes a reed switch disposed in a second sensor housing carried on the other of the drum and the cable follower member.

3. The drain cleaning apparatus according to claim 2 wherein:

said processor is disposed on a one of said first and second sensor housings.

4. The drain cleaning apparatus according to claim 3 wherein said cable counter further includes:

a display device including a display configured to display information readable by a human operator of the drain cleaning apparatus; and, a signal transmission portion configured to transmit said signal from said processor to said display device.

5. The drain cleaning apparatus according to claim 4 wherein:

said signal transmission portion includes a radio frequency (RF) link configured to transmit said signal from said processor to said display device.

6. The drain cleaning apparatus according to claim 5 wherein:

said display device includes a display housing mounted in a fixed relationship relative to said frame.

7. The drain cleaning apparatus according to claim 4 wherein:

said signal transmission portion includes a one of an infrared (IR) link and a slip ring link configured to transmit said signal from said processor to said display device.

8. The drain cleaning apparatus according to claim 1 wherein:

said first and second sensor portions include a one of first and second optical sensor portions, first and second infrared (IR) sensor portions, and first and second hall-effect sensor portions for sensing (said) relative movement between said drum and said cable follower member in said first and second directions.

9. The drain cleaning apparatus according to claim 1 wherein:

said cable is disposed in said drum in a coil having multiple wraps/turns; and, said cable follower moves in said first relative direction to said drum one complete rotation in a first direction for each turn of cable payed out from said drum and moves in said second relative direction to said drum one complete rotation in a second direction for each turn of cable retracted into said drum.

10. The drain cleaning apparatus of claim 1 wherein the first and second sensor portions include a radio frequency identification (RFID) tag and a radio frequency identification reader.

11. An electronic snake/cable counter for use with an associated drain cleaning apparatus of the type including a frame, a drum supported relative to the frame for rotation about a first axis, the drum including a main housing portion defining an opening therethrough, a flexible drain cleaning cable carried by and rotatable with the drum, the cable being axially displaceable outwardly of the drum through the opening to pay out portions of the cable from the drum and being axially displaceable inwardly of the drum through the opening to retract portions of the cable into the drum, a cable follower member configured to engage the cable and supported for movement in a first direction relative to the drum as the cable is payed out of the drum and in a second direction relative to the drum as the snake is retracted into the drum, the electronic cable counter comprising:

a first sensor portion on said drum of the associated drain cleaning apparatus;

a second sensor portion on said cable follower member of the associated drain cleaning apparatus, the first and second sensor portions sensing said relative movement between the drum and the follower member in said first and second directions; and, a processor in operative communication with said first and second sensor portions for determining an amount of said cable payed out from the drum and generating a signal representative of said amount.

12. The electronic cable counter according to claim 11 wherein:

said first sensor portion includes a magnet disposed in a first sensor housing carried on a one of the said drum and said cable follower member of the associated drain cleaning apparatus; and, said second sensor portion includes a reed switch disposed in a second sensor housing carried on the other of said drum and said cable follower member of the associated drain cleaning apparatus.

13. The electronic cable counter according to claim 12 wherein:

said processor is disposed in a one of said first and second sensor housings.

14. The electronic cable counter according to claim 11 further including:

a display device including a display configured to display information readable by a human operator of the associated drain cleaning apparatus; and, a signal transmission portion configured to transmit said signal from said processor to said display device.

15. The electronic cable counter according to claim 14 wherein:

said signal transmission portion includes a radio frequency (RF) link configured to transmit said signal from said processor to said display device.

16. The electronic cable counter according to claim 15 wherein:

said display device includes a display housing mounted in a fixed relationship relative to said frame of the associated drain cleaning apparatus.

17. The electronic cable counter according to claim 14 wherein:

said signal transmission portion includes a one of an infrared (IR) link and a slip ring link configured to transmit said signal from said processor to said display device.

18. The electronic cable counter according to claim 11 wherein:

said first and second sensor portions include a one of first and second optical sensor portions, first and second infrared (IR) sensor portions, and first and second hall-effect sensor portions for sensing said relative movement between said drum and said cable follower member of the associated drain cleaning apparatus in said first and second directions.

19. The electronic cable counter according to claim 11 wherein said cable of the associated drain cleaning apparatus is disposed in said drum in a coil having multiple wraps/turns, and said cable follower moves in said first relative direction to said drum one complete rotation in a first direction for each turn of cable payed out from said drum and moves in said second relative direction to said drum one complete rotation in a second direction for each turn of cable retracted into said drum, and wherein:

said first and second sensor portions are adapted to generate a quadrature signal representative of said relative movement between said cable follower and said drum; and, said processor is configured to detect said quadrature signal, determine said first and second directions of said relative rotational movement between said cable follower and said drum, and generate a signal representative of a direction of movement of said cable inwardly and outwardly of said drum.

20. The electronic cable counter of claim 11 wherein the first sensor portion is a radio frequency identification (RFID) tag and the second sensor portion is a radio frequency identification (RFID) reader.

* * * * *